US010220613B2

(12) United States Patent
Arakane et al.

(10) Patent No.: US 10,220,613 B2
(45) Date of Patent: Mar. 5, 2019

(54) INK-JET PRINTER

(71) Applicant: BROTHER KOGYO KABUSHIKI KAISHA, Nagoya-shi, Aichi-ken (JP)

(72) Inventors: Satoru Arakane, Nagoya (JP); Yuki Matsui, Kiyosu (JP); Masayoshi Hayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/911,322

(22) Filed: Mar. 5, 2018

(65) Prior Publication Data

US 2018/0281386 A1 Oct. 4, 2018

(30) Foreign Application Priority Data

Mar. 29, 2017 (JP) ..... 2017-064559

(51) Int. Cl.
*B41J 2/045* (2006.01)
*B41J 2/145* (2006.01)

(52) U.S. Cl.
CPC ..... *B41J 2/0457* (2013.01); *B41J 2/04581* (2013.01); *B41J 2/145* (2013.01); *B41J 2/04551* (2013.01)

(58) Field of Classification Search
CPC ..... B41J 2/04581; B41J 2/04596; B41J 2/04541; B41J 2/0457; B41J 2/04551
See application file for complete search history.

(56) References Cited

U.S. PATENT DOCUMENTS

2001/0020962 A1 9/2001 Kanaya et al.
2012/0327150 A1 12/2012 Takagi
2016/0089878 A1 3/2016 Yamashita
2018/0072055 A1* 3/2018 Kiji ..... B41J 2/04541

FOREIGN PATENT DOCUMENTS

JP 3587111 B2 11/2004
JP 2007-125823 A 5/2007
JP 2013-006363 A 1/2013
JP 2016-068486 A 5/2016

* cited by examiner

*Primary Examiner* — Thinh H Nguyen
(74) *Attorney, Agent, or Firm* — Scully, Scott, Murphy & Presser, PC

(57) ABSTRACT

There is provided an ink-jet printer including: a recording head; a power supply; and a controller. In a case that the controller obtains a maintenance instruction, the controller performs: boosting driving voltage to a target voltage value, in accordance with a first pattern; and applying the driving voltage to at least one of driving elements. In a case that the controller obtains an image recording instruction, the controller performs: boosting the driving voltage to the target voltage value, in accordance with a second pattern having a voltage boosting time shorter than the first pattern; and recording an image on a sheet by selectively applying the driving voltage, boosted to the target voltage value, to the driving elements.

22 Claims, 12 Drawing Sheets

Fig. 7A

| i | SET VOLTAGE VALUE V | STAND-BY TIME T | SAMPLING INTERVAL I | NUMBER OF SAMPLE N | THRESHOLD VALUE Th |
|---|---|---|---|---|---|
| 1 | 14V | 30msec | 10msec | 6 | 13.5V |
| 2 | 22V | 30msec | 10msec | 6 | 21.5V |
| 3 | 24V | 30msec | 10msec | 6 | 23.75V |

Fig. 7B

| i | SET VOLTAGE VALUE V | STAND-BY TIME T | SAMPLING INTERVAL I | NUMBER OF SAMPLE N | THRESHOLD VALUE Th |
|---|---|---|---|---|---|
| 1 | 14V | 20msec | 5msec | 3 | 13.0V |
| 2 | 22V | 25msec | 7msec | 4 | 21.0V |
| 3 | 24V | 27.5msec | 9msec | 5 | 23.05V |

INK-JET PRINTER

CROSS REFERENCE TO RELATED APPLICATION

The present application claims priority from Japanese Patent Application No. 2017-064559 filed on Mar. 29, 2017 the disclosure of which is incorporated herein by reference in its entirety.

BACKGROUND

Field of the Invention

The present teaching relates to an ink-jet printer configured to record an image, etc. on a sheet.

Description of the Related Art

Conventionally, an attempt is made, in an information processing apparatus and a printer which are connected to each other via a communication network, to shorten FPOT (abbreviation of First Print Out Time) that is a time since a print instruction or command is input to the information processing apparatus (terminal) until a first sheet is discharged from the printer. Further, as one of the methods for shortening the FPOT, it is considered to shorten the time for a preparing processing.

The preparing processing is a processing that the printer should execute before the printer records an image on a sheet, and is exemplified, for example, by a voltage boosting processing for boosting a driving voltage to be applied to a recording head, a flushing processing for causing the recording head to jet or discharge an ink toward an ink receiving section, a drive switching processing for switching a transmittance destination to which the driving force generated by a motor is transmitted, an initial conveying processing for conveying the sheet up to a position at which the sheet faces (is opposite to) the recording head, etc.

SUMMARY

The respective processings composing the preparing processing include a processing which cannot be executed unless another processing or processings is/are ended, a processing which is executable in parallel with another processing or processings, etc. Therefore, the execution time for the preparing processing is a sum of the executing times of the respective processings which are executed in series. On the other hand, the execution time of each of the respective processings composing the preparing processing is set to be longer than a minimum required time so as to reduce any load on the constitutive elements or parts (for example, a motor, a gear, an electronic circuit, etc.) of the ink-jet recording apparatus. Accordingly, simply reducing the execution time of each of the respective processings composing the preparing processing would not be appropriate or suitable.

The present teaching has been made in view of the above-described situation, and an object of the present teaching is to provide an ink-jet recording apparatus, such as an ink-jet printer, capable of shortening the FPOT while reducing the load on the constitutive elements or parts of the ink-jet recording apparatus.

According to a first aspect of the present teaching, there is provided an ink-jet printer including: a recording head having a plurality of nozzles and a plurality of driving elements corresponding to the plurality of nozzles, respectively; a power supply configured to apply a driving voltage to the plurality of driving elements; and a controller. In a case that the controller obtains an instruction of performing maintenance for the recording head, the controller is configured to perform: boosting the driving voltage of the power supply to a target voltage value, in accordance with a first voltage boosting pattern; and applying the driving voltage, which has been boosted to the target voltage value, to at least one of the plurality of driving elements. In a case that the controller obtains an instruction of recording an image on a medium, the controller is configured to perform: boosting the driving voltage of the power supply to the target voltage value, in accordance with a second voltage boosting pattern having a voltage boosting time being shorter than that in the first voltage boosting pattern; and recording the image on the medium by applying the driving voltage, which has been boosted to the target voltage value, selectively to the plurality of driving elements in accordance with the instruction of recording the image on the medium.

According to the above-described configuration, the driving voltage is boosted to the target voltage value in accordance with the second voltage boosting pattern, in a case that the controller obtains the image recording instruction. Therefore, it is possible to shorten the FPOT as compared with a case in which the voltage boosting processing for boosting the driving voltage to the target voltage value is executed in accordance with the first voltage boosting pattern. Note that the second voltage boosting pattern is not such a pattern by which the driving voltage is boosted rapidly to such an extent that any large load is applied on an electronic circuit configured to boost the voltage of the power supply. If, however, the voltage boosting processing in accordance with the second voltage boosting pattern is repeatedly executed, any small or slight load is consequently accumulated in the electronic circuit. In view of this, in a case that the maintenance processing for which the needs for shortening the execution time is lower than in the recording processing, the first voltage boosting pattern in which the driving voltage is boosted in the relatively long voltage boosting time is used, thereby making it possible to reduce the load which would have otherwise accumulated in the electronic circuit.

According to a second aspect of the present teaching, there is provided an ink-jet printer including: a recording head having a plurality of nozzles and a plurality of driving elements corresponding to the plurality of nozzles, respectively; a power supply configured to apply a driving voltage to the plurality of driving elements; and a controller. In a case that the controller obtains an instruction of boosting of the driving voltage, the controller is configured to repeatedly perform, in an execution time Tx: instructing the power supply to boost the driving voltage to a set voltage value V; obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V. Under a condition that the controller determines that the representative value is not less than the threshold value Th, the controller is configured to instruct the power supply to boost the driving voltage again to the set voltage value V, while raising the set voltage value V and the threshold value Th. The controller is configured to make the execution time Tx, in a case that the set voltage value V is a first voltage value, to be shorter than the execution time Tx in a case that the set voltage value V is a second voltage value higher than the first voltage value.

According to a third aspect of the present teaching, there is provided an ink-jet printer including: a recording head having a plurality of nozzles and a plurality of driving elements corresponding to the plurality of nozzles; a power supply configured to apply a driving voltage to the plurality of driving elements; and a controller. In a case that the controller obtains a voltage boosting instruction which does not involve jetting of an ink from the plurality of nozzles, the controller is configured to perform boosting the driving voltage of the power supply to a target voltage value, in accordance with a first voltage boosting pattern. In a case that the controller obtains a voltage boosting instruction which involves the jetting of the ink, the controller is configured to perform boosting of the driving voltage of the power supply to the target voltage value, in accordance with a second voltage boosting pattern having a voltage boosting time being shorter than that in the first voltage boosting pattern. The controller is configured to apply the driving voltage, which has been boosted to the target voltage value, to the plurality of driving elements.

According to a fourth aspect of the present teaching, there is provided an ink-jet printer including: a recording head having a plurality of nozzles and a plurality of driving elements corresponding to the plurality of nozzles, respectively; a power supply configured to apply a driving voltage to the plurality of driving elements; and a controller. In a case that the controller obtains a voltage boosting instruction under a first condition, the controller is configured to perform boosting the driving voltage of the power supply to a target voltage value, in accordance with a first voltage boosting pattern. In a case that the controller obtains a voltage boosting instruction under a second condition being different from the first condition, the controller is configured to perform boosting the driving voltage of the power supply to the target voltage value, in accordance with a second voltage boosting pattern in which a voltage boosting time is shorter than that in the first voltage boosting pattern.

According to the present teaching, since the switching is executed between the boosting of the voltage in accordance with the first voltage boosting pattern and the boosting of the voltage in accordance with the second voltage boosting pattern, based on the obtained instruction, it is possible to realize both of the shortening of the FPOT and the reduction of the load accumulated in the electronic circuit.

BRIEF DESCRIPTION OF THE DRAWINGS

FIGS. 5A, 5B and 5C are each a view schematically depicting the configuration of a switching section 170, wherein FIG. 5A depicts a first state, FIG. 5B depicts a second state, and FIG. 5C depicts a third state of the switching section 170.

FIGS. 7A and 7B each depict an example of a voltage boosting table, wherein FIG. 7A depicts a first voltage boosting table, and FIG. 7B depicts a second voltage boosting table.

DESCRIPTION OF THE EMBODIMENTS

Figure 1:
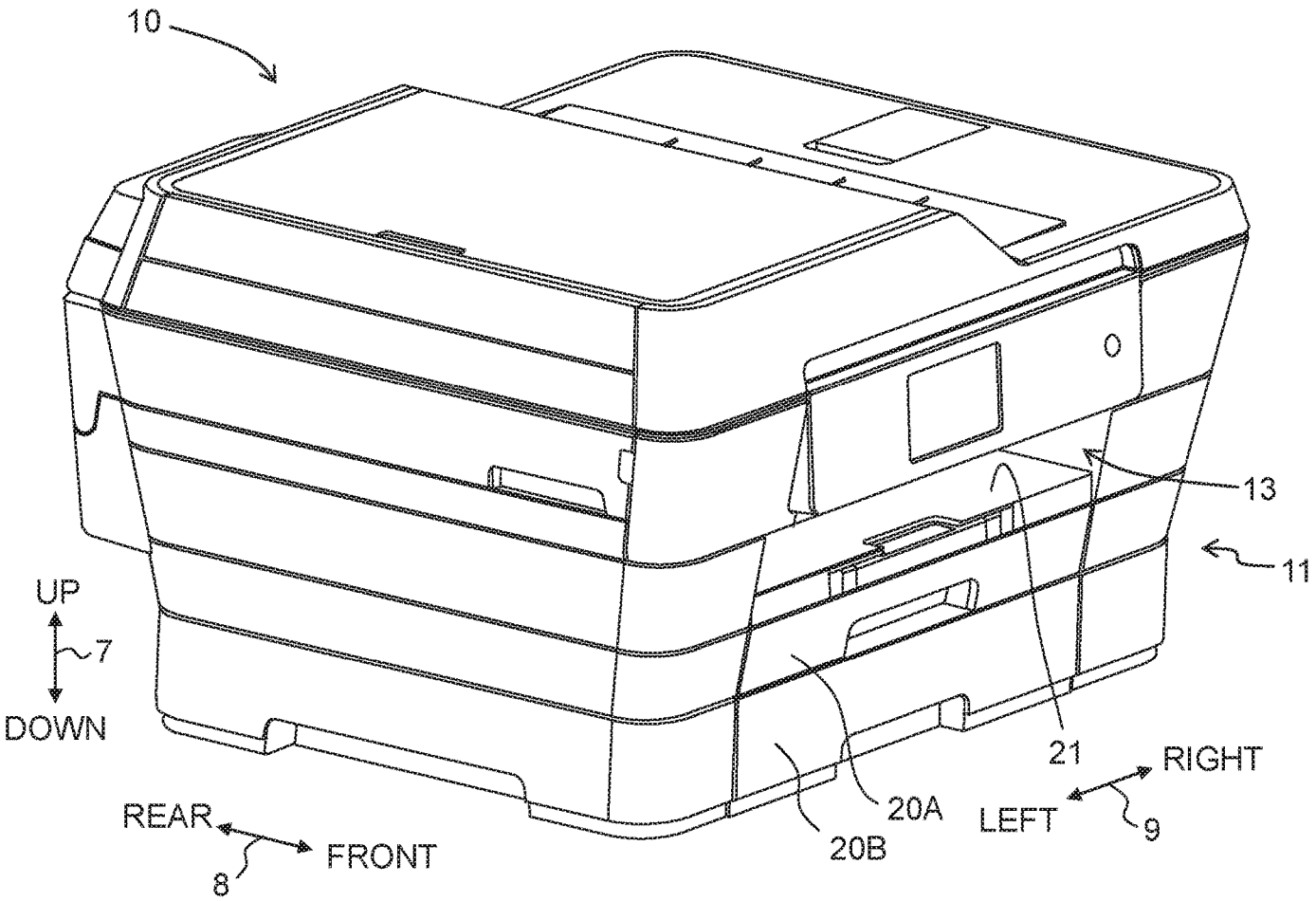
FIG. 1 is a perspective view depicting the outer appearance of a multi-function peripheral 10.

In the following, an embodiment of the present teaching will be explained, with reference to the drawings. Note that, however, the embodiment explained below is merely an example of the present teaching; it goes without saying that it is possible to make any appropriate change(s) in the embodiment of the present teaching without departing from the gist and/or scope of the present teaching. Further, in the following explanation, an up-down direction 7 is defined with a state in which a multi-function peripheral 10 is usably installed (a usable state; a state depicted in FIG. 1), as the reference; a front-rear direction 8 is defined, with a side on which an opening 13 of the multi-function peripheral 10 is provided is designated as the frontward side (front surface or front side); and a left-right direction 9 is defined as viewing the multi-function peripheral 10 from the frontward side (front surface).

<Overall Configuration of Multi-Function Peripheral 10>

As depicted in FIG. 1, the multi-function peripheral 10 is formed to have a substantially rectangular parallelepiped shape. The multi-function peripheral 10 includes a printer 11. The multi-function peripheral 10 is an example of an ink-jet recording apparatus. Further, the multi-function peripheral 10 may further include, for example, a scanner which is configured to read an original (manuscript) and to generate an image data of an image in the original; etc.

<Printer 11>

Figure 2:
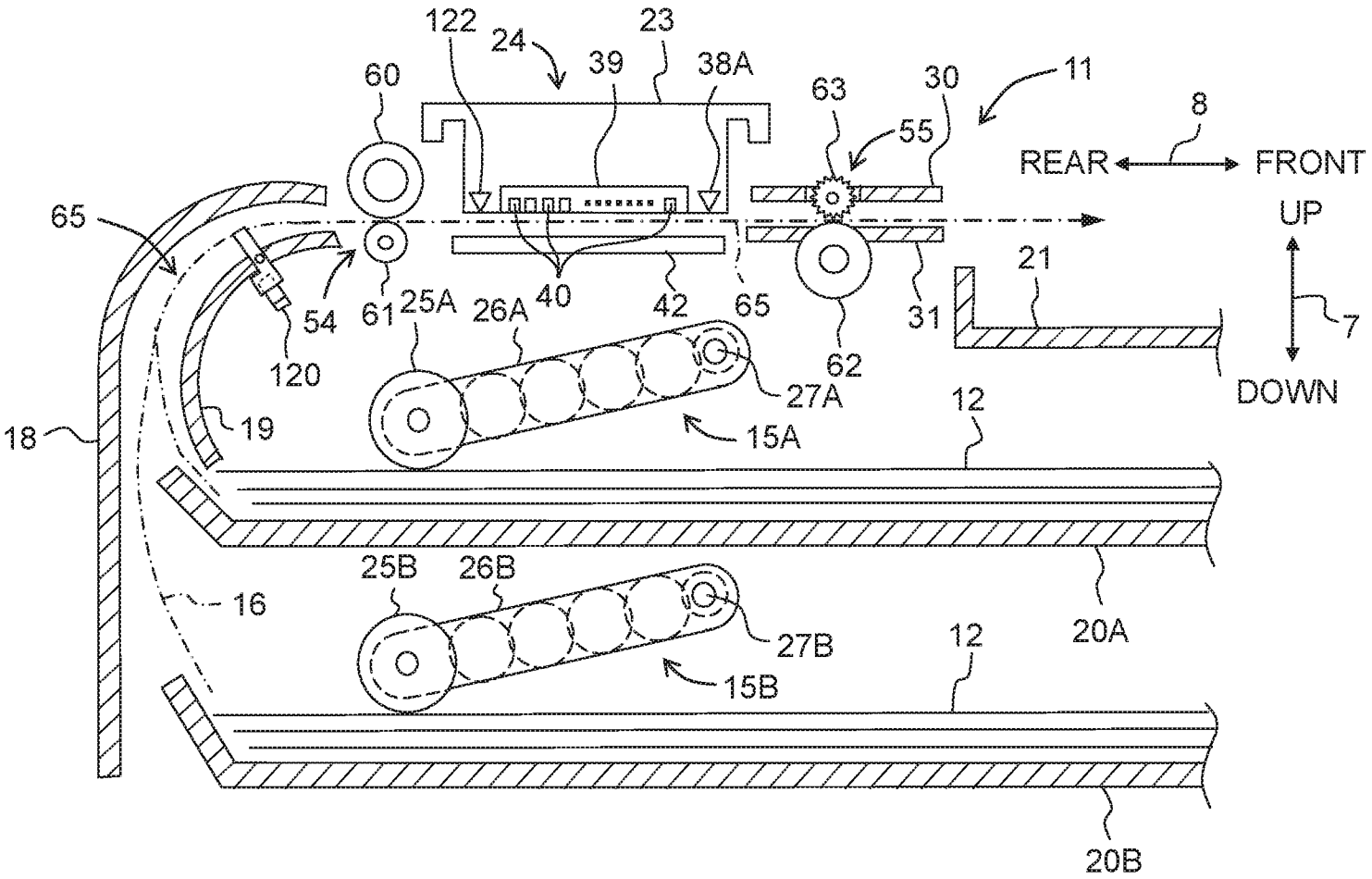
FIG. 2 is a vertical cross-sectional view schematically depicting the internal structure of a printer 11.

The printer 11 records an image, indicated by the image data, on a sheet 12 (see FIG. 2) by jetting (discharging) an ink onto the sheet 12. Namely, the printer 11 adopts a so-called ink-jet recording system. As depicted in FIG. 2, the printer 11 is provided with feeding sections 15A and 15B, feed trays 20A and 20B, a discharge tray 21, a conveyance roller section 54, a recording section 24, a discharge roller section 55, and a platen 42.

<Feed Trays 20A and 20B, Discharge Tray 21>

The opening 13 (see FIG. 1) is formed in the front surface of the printer 11. The feed trays 20A and 20B are inserted into or removed from the printer 11 in the front-rear direction 8 through the opening 13. The feed trays 20A and 20B each support a plurality of pieces of the sheet 12 that are stacked in the feed tray 20A, 20B. The discharge tray 21 supports the sheet 12 discharged by the discharge roller section 55 via the opening 13.

<Feeding Sections 15A and 15B>

As depicted in FIG. 2, the feeding section 15A includes a feeding roller 25A, a feeding arm 26A, and a shaft 27A. The feeding roller 25A is rotatably supported by the feeding arm 26A at a front end thereof. The feeding arm 26A is pivotably supported by the shaft 27A supported by a frame of the printer 11. The feeding arm 26A is urged toward the feeding tray 20A by a bias which is applied thereto by an elastic force of a spring or by the self-weight of the feeding arm 26A such that the feeding arm 26A is pivoted toward the feed tray 20A. The feeding section 15B includes a feeding roller 25B, a feeding arm 26B, and a shaft 27B. Since the specific construction of the feeding section 15B is common with that of the feeding section 15A, the explanation therefor will be omitted. The feeding section 15A feeds, with the feeding roller 25A, a sheet 12 supported by the feed tray 20A to a conveyance route 65. The feeding roller 25A is rotated by a driving force generated by the rotation of a feeding motor 101 (see FIG. 6) in a normal direction and transmitted to the feeding roller 25A. The feeding section 15B feeds, with the feeding roller 25B, a sheet 12 supported by the feed tray 20B to the conveyance route 65. The feeding roller 25B is rotated by a driving force generated by the rotation of the feeding motor 101 in the normal direction and transmitted to the feeding roller 25B.

<Conveyance Route 65>

The conveyance route 65 is defined by guide members 18 and 30 and guide members 19 and 31. The guide member 18 and the guide member 19 face with each other with a predetermined interval or gap intervened therebetween and the guide member 30 and the guide member 31 face with each other with a predetermined interval intervened therebetween, in the interior of the printer 11. The conveyance route 65 is a route or path which extends from rear-end portions of the feed trays 20A and 20B toward the rear side of the printer 11. Further, the conveyance route 65 makes a U-turn frontwardly while extending from the lower side to the upper side, at the rear side of the printer 11; and then the conveyance route 65 reaches the discharge tray 21 via the recording section 24. Note that a conveyance direction 16 in which the sheet 12 is conveyed inside the conveyance route 65 is indicated by an arrow of a dot-dash chain line in FIG. 2.

<Conveyance Roller Section 54>

The conveyance roller section 54 is arranged on the upstream side from the recording section 24 in the conveyance direction 16. The conveyance roller section 54 includes a conveyance roller 60 and a pinch roller 61 which are facing each other. The conveyance roller 60 is driven by a conveyance motor 102 (see FIG. 6). The pinch roller 61 rotates following the rotation of the conveyance roller 60. The sheet 12 is conveyed in the conveyance direction 16 by being pinched between the conveyance roller 60 and the pinch roller 61. In this situation, the conveyance roller 60 is rotated in the normal direction (rotated normally or positively) by being transmitted with a driving force generated by the rotation of the conveyance motor 102 in the normal direction, and conveys the sheet 12 in the conveyance direction 16. The conveyance roller 60 rotates in a reverse direction, which is reverse to that of the normal direction of the normal rotation, by being transmitted with a driving force generated by the rotation of the conveyance motor 102 in the reverse direction.

<Discharge Roller Section 55>

The discharge roller section 55 is arranged downstream from the recording section 24 in the conveyance direction 16. The discharge roller section 55 includes a discharge roller 62 and a spur 63 which are facing each other. The discharge roller 62 is driven by the conveyance motor 102. The spur 63 rotates following the rotation of the discharge roller 62. The sheet 12 is conveyed in the conveyance direction 16 by being pinched between the discharge roller 62 and the spur 63. In this situation, the discharge roller 62 is rotated in the normal direction by being transmitted with the driving force generated by the rotation of the conveyance motor 102 in the normal direction.

<Registration Sensor 120>

As depicted in FIG. 2, the printer 11 is provided with a registration sensor 120. The registration sensor 120 is arranged upstream from the conveyance roller section 54 in the conveyance direction 16. The registration sensor 120 outputs different detection signals, depending on whether or not the sheet 12 is present at an arrangement position. Under a condition that the sheet 12 is present at the arrangement position, the registration sensor 120 outputs a HIGH level signal to a controller 130 (to be described later on; see FIG. 6). On the other hand, under a condition that the sheet 12 is not present (is absent) at the arrangement position, the registration sensor 120 outputs a LOW level signal to controller 130.

<Rotary Encoder 121>

Figure 6:
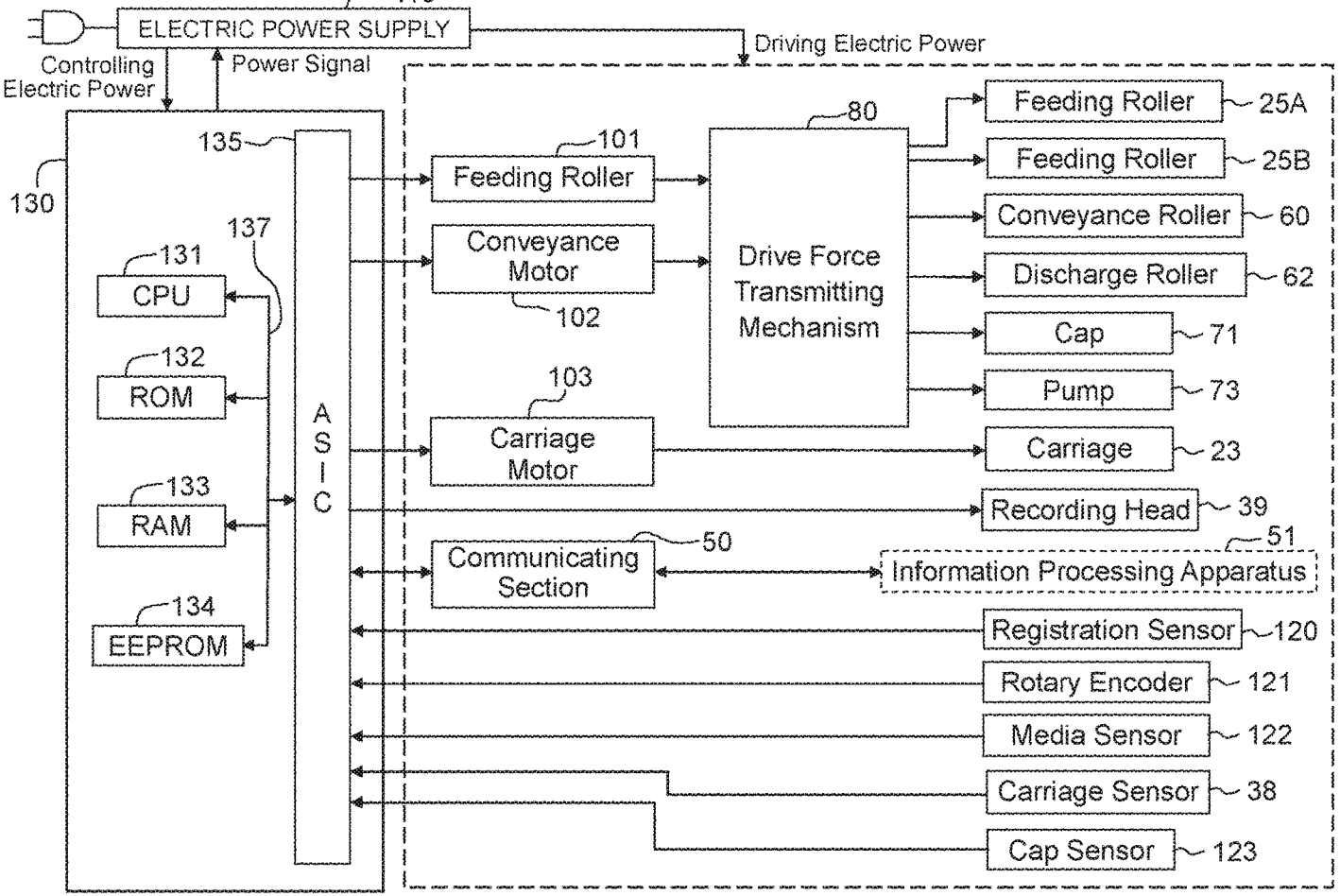
FIG. 6 is a block diagram of the multi-function peripheral 10.

As depicted in FIG. 6, the printer 11 is provided with a rotary encoder 121 which is configured to generate a pulse signal depending on the rotation of the conveyance roller 60 (in other words, the rotary driving of the conveyance motor 102). The rotary encoder 121 is provided with an encoder disc and an optical sensor. The encoder disc rotates together with the rotation of the conveyance roller 60. The optical sensor reads the rotating encoder disc so as to generate a pulse signal, and outputs the generated pulse signal to the controller 130.

<Recording Section 24>

Figure 3:
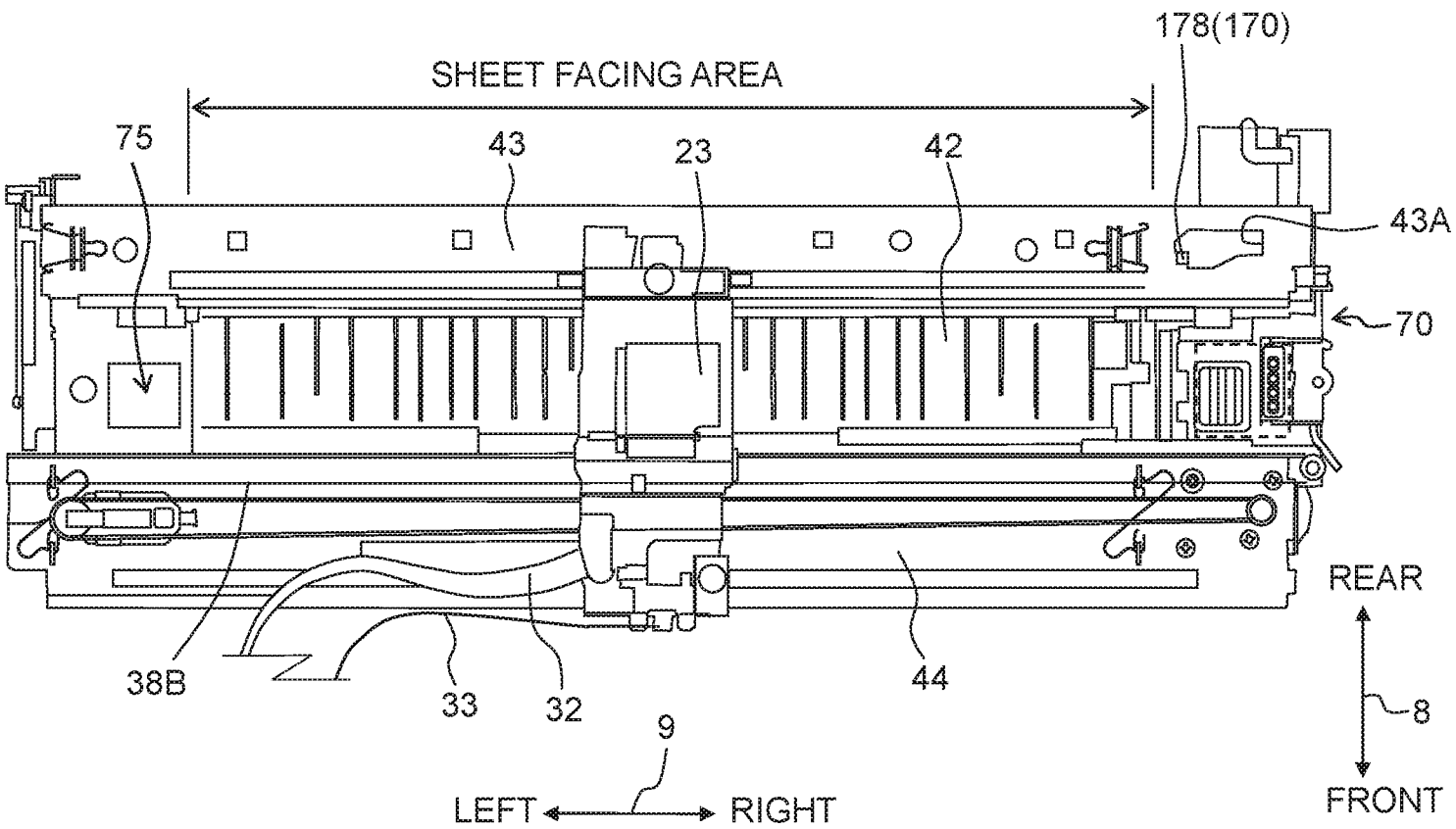
FIG. 3 is a plane view of a carriage 23 and guide rails 43 and 44.

As depicted in FIG. 2, the recording section 24 is arranged between the conveyance roller section 54 and the discharge roller section 55 in the conveyance direction 16. Further, the recording section 24 is arranged to face the platen 42 in the up-down direction 7. Furthermore, the recording section 24 includes a carriage 23, a recording head 39, an encoder sensor 38A and a media sensor 122. Further, as depicted in FIG. 3, an ink tube 32 and a flexible flat cable 33 are connected to the carriage 23. An ink in an ink cartridge is supplied to the recording head 39 via the ink tube 32. The flexible flat cable 33 electrically connects the recording head 39 to a control circuit board having the controller 130 mounted thereon.

As depicted in FIG. 3, the carriage 23 is supported by guide rails 43 and 44 which are extended respectively in the left-right direction 9, at positions separated respectively in the front-rear direction 8. The carriage 23 is connected to a known belt mechanism disposed on the guide rail 44. Note that the belt mechanism is driven by a carriage motor 103 (see FIG. 6). Namely, the carriage 23, connected to the belt mechanism which circumferentially moves by being driven by the carriage motor 103, is capable of reciprocating in the left-right direction 9 in an area including a sheet facing area.

The sheet facing area means an area in a main scanning direction in which an object such as the carriage 23 may face a sheet 12 conveyed by the conveyance roller section 54 and the discharge roller section 55. In other words, the sheet facing area means an area which is included in a space located above the sheet conveyed onto the platen 42 by the conveyance roller section 54 and the discharge roller section 55 and in which the carriage 23 may pass therethrough. Further, the carriage 23 is capable of moving in the left-right direction 9 between an area located on the left side from the sheet facing area and another area located on the right side from the sheet facing area. The left-right direction 9 is an example of the main scanning direction.

As depicted in FIG. 2, the recording head 39 is installed or mounted on the carriage 23. A plurality of nozzles 40 is formed in the lower surface of the recording head 39. In the following description, the lower surface of the recording head 39 will be referred to as a "nozzle surface". Further, the recording head 39 has a plurality of driving elements which correspond to the plurality of nozzles 40, respectively. Namely, the recording head 39 has a plurality of nozzles and a plurality of driving elements as a plurality of sets thereof, each of the sets including one of the plurality of nozzles and one of the plurality of driving elements. In the recording head 39, each of the driving elements such as a piezoelectric element is vibrated to thereby jet or discharge an ink droplet of an ink through one of the nozzles 40. In a process during which the carriage 23 is moved, the recording head 39 jets the ink droplets toward the sheet 12 supported by the platen 42. Accordingly, an image, etc., is recorded on the sheet 12.

The driving element is an example of a jetting energy-generating element which generates, from driving voltage applied by an power supply 110 (see FIG. 6), an energy for causing the ink droplet to be jetted or discharged from the nozzle 40 (namely, the vibrational energy). Note that, however, the specific example of the jetting-energy generating element is not limited to the driving element, and may be, for example, a heater which generates thermal energy. Further, the heater may heat the ink by thermal energy generated from a driving voltage applied by the electrical power supply 110, and may cause an ink droplet, which is foamed by being heated, to be jetted from the nozzle. Furthermore, although the recording head 39 according to the present embodiment jets a pigment ink, the recording head 39 may jet a dye ink.

The plurality of nozzles 40 are arranged in rows in the front-rear direction 8 and the left-right direction 9, as depicted in FIGS. 2 and 4. The nozzles 40 arranged to form a row in the front-rear direction 8 (hereinafter referred to as a "nozzle row") jet ink droplets of a same color. The nozzle surface is formed with 24 nozzle rows which are arranged in the left-right direction 9. Further, every six adjacent nozzle rows, among the 24 nozzle rows, jet ink droplets of a same color ink. In the present embodiment, among the 24 nozzle rows, six nozzle rows from the right end jet ink droplets of a black ink, another six nozzle rows adjacent to the six nozzle rows jet ink droplets of a yellow ink, yet another six nozzle rows adjacent to the another six nozzle rows jet ink droplets of a cyan ink, and still yet another six nozzle rows from the left end jet ink droplets of a magenta ink. Note that, however, the combination of the number of the nozzle row and the colors of inks to be jetted are not limited to the above-described examples.

Further, an encoder strip 38B, which has a band-shape and which extends in the left-right direction 9, is arranged on the guide rail 44, as depicted in FIG. 3. The encoder sensor 38A is mounted on the lower surface of the carriage 23 at a position at which the encoder sensor 38A faces the encoder strip 38B. In a process in which the carriage 23 is moved, the encoder sensor 38A reads the encoder strip 38B to thereby generate a pulse signal, and outputs the generated pulse signal to the controller 130. The encoder sensor 38A and the encoder strip 38B construct a carriage sensor 38 (see FIG. 6).

<Media Sensor 122>

As depicted in FIG. 2, the media sensor 122 is mounted on the carriage 23 at the lower surface (surface facing the platen 42) of the carriage 23. The media sensor 122 is provided with a light emitting section constructed of a light emitting diode, etc., and a light receiving section constructed of an optical sensor, etc. The light emitting section irradiates a light at a light amount instructed by the controller 130 toward the platen 42. The light irradiated from the light emitting section is reflected by the platen 42 or a sheet 12 supported by the platen 42, and the reflected light is received by the light receiving section. The media sensor 122 outputs, to the controller 130, a detection signal depending on a light receiving amount in the light receiving section. For example, as the light receiving amount is greater, the media sensor 122 outputs a detection signal of higher level to the controller 130.

<Platen 42>

As depicted in FIG. 2, the platen 42 is arranged between the conveyance roller section 54 and the discharge roller section 55 in the conveyance direction 16. The platen 42 is arranged so as to face the recording section 24 in the up-down direction 7. The plane 42 supports the sheet 12, conveyed by at least one of the conveyance roller section 54 and the discharge roller section 55, from therebelow. The light reflectance of the platen 42 in the present embodiment is set to be lower than that of the sheet 12.

<Maintenance Section 70>

As depicted in FIG. 3, the printer 11 is further provided with a maintenance section 70. The maintenance section 70 is configured to perform maintenance for the recording head 39. More specifically, the maintenance section 70 executes a purge operation of sucking an ink and/or air inside the nozzles 40, and any foreign matter or substance adhered to the nozzle surface. In the following explanation, although it is simply described that the maintenance section 70 sucks the ink, what is sucked by the maintenance section 70 is not limited to the ink inside the nozzles 40; in addition to the ink inside the nozzles 40, for example, air inside the nozzles 40 and any foreign matter or substance adhered to the nozzle surface are also sucked by the maintenance section at the same time with the ink inside the nozzles 40. The ink sucked and removed by the maintenance section 70 is stored in a waste liquid tank 74 (see FIG. 4A). As depicted in FIG. 3, the maintenance section 70 is arranged at a location which is on the right side relative to the sheet facing area and which is below the sheet facing area. The maintenance section 70 is provided with a cap 71, a tube 72 and a pump 73, as depicted in FIG. 4A.

The cap 71 is constructed of a rubber. In a case that the carriage 23 is located at a maintenance position on the right side relative to the sheet facing area, the cap 71 is located at a position at which the cap 71 faces the recording head 39 mounted on the carriage 23. The tube 72 reaches the waste liquid tank 74 from the cap 71 and via the pump 73. The pump 73 is, for example, a tube pump of a rotary system. The pump 73 is driven by the conveyance motor 102 to thereby suck the ink inside the nozzles 40 via the cap 71 and the tube 72, and to discharge the sucked ink to the waste liquid tank 74 via the tube 72.

The cap 71 is constructed, for example, to be movable between a covering position and a separate position which are separate and away in the up-down direction 7. The cap 71 located at the covering position makes tight contact with the recording head 39 mounted on the carriage 23 which is located at the maintenance position, and covers the nozzle surface. On the other hand, the cap 71 located at the separate position is separated and away from the nozzle surface. The cap 71 is movable between the covering position and the separate position by a non-illustrated ascending/descending mechanism which is driven by the feeding motor 101. Note that, however, the specific configuration for causing the cap 71 to make contact with the recording head 39 and for separating the cap 71 from the recording head 39 is not limited to the above-described example.

As another example, it is allowable that the cap 71 is moved by a non-illustrated link mechanism which operates accompanying with the movement of the carriage 23, instead of being moved by the ascending/descending mechanism driven by the feeding motor 101. The posture of the link mechanism is changeable from a first posture in which the link mechanism holds the cap 71 at the covering position, and a second posture in which the link mechanism holds the cap 71 at the separate position. For example, the link mechanism is contacted by the carriage 23 moving rightwardly toward the maintenance position and thus the posture of the link mechanism is changed from the second posture into the first posture. On the other hand, for example, the link mechanism is contacted by the carriage 23 moving leftwardly from the maintenance position and thus the posture of the link mechanism is changed from the first posture into the second posture.

As still another example, it is allowable that the multi-function peripheral 10 is provided with an ascending/descending mechanism which moves the guide rails 43 and 44 in the up-down direction 7, instead of the mechanism which moves the cap 71. Namely, the carriage 23 at the maintenance position is ascended/descended together with the guide rails 43 and 44 which are ascended/descended by the ascending/descending mechanism. On the other hand, the cap 71 is fixed to a position at which the cap 71 faces the recording head 39 mounted on the carriage 23 which is located at the maintenance position. Further, the guide rails 43 and 44 and the carriage 23 are lowered or descended to a predetermined position by the ascending/descending mechanism, thereby allowing the nozzle surface of the recording head 39 to be covered by the cap 71. On the other hand, the guide rails 43 and 44 and the carriage 23 are lifted or ascended to another predetermined position by the ascending/descending mechanism, thereby allowing the recording head 39 and the cap 71 to be separated away from each other, and allowing the carriage 23 to be movable in the main scanning direction.

As yet another example, it is allowable that the multi-function peripheral 10 is provided with both the ascending/descending mechanism which moves the cap 71 and the ascending/descending mechanism which moves the guide rails 43 and 44. Further, it is allowable that the carriage 23 and the cap 71 are moved in directions, respectively, such that the carriage 23 and the cap 71 approach closely to each other, thereby bringing the cap 71 into a tight contact with the nozzle surface. Furthermore, it is allowable that the carriage 23 and the cap 71 are moved in directions, respectively, such that the carriage 23 and the cap 71 are separated away from each other, thereby allowing the cap 71 to be separated away from the nozzle surface. Namely, the above-described covering position and separate position are each a relative position of the cap 71 relative to the recording head 39. Further, by moving one or both of the recording head 39 and the cap 71, the relative position of the cap 71 relative to the recording head 39 may be changed. In other words, by moving the recording head 39 and the cap 71 relative to each other, the relative position of the cap 71 relative to the recording head 39 may be changed.

<Cap Sensor 123>

As depicted in FIG. 6, the printer 11 is further provided with a cap sensor 123. The cap sensor 123 outputs different detection signals, depending on whether or not the cap 71 is located at the covering position. Under a condition that the cap 71 is located at the covering position, the cap sensor 123 outputs a HIGH level signal to the controller 130. On the other hand, under a condition that the cap 71 is located at a position different from the covering position, the cap sensor 123 outputs a LOW level signal to controller 130. Note that in a case that the cap 71 is moved from the covering position to the separate position, the detection signal output from the cap sensor 123 changes from the HIGH level signal to the LOW level signal before the cap 71 reaches the separate position.

<Ink Receiving Section 75>

As depicted in FIG. 3, the printer 11 is further provided with an ink receiving section 75. The ink receiving section 75 is arranged at a location which is on the left side relative to the sheet facing area and which is below the sheet facing area. More specifically, in a case that the carriage 23 is located on the left side relative to the sheet facing area, the ink receiving section 75 is arranged at a position at which the ink receiving section 75 faces the lower surface of the recording head 39 mounted on the carriage 23. Note that it is allowable that the maintenance section 70 and the ink receiving section 75 are arranged on a same side in the main scanning direction, with the sheet facing area as the reference. Note that, however, the maintenance section 70 and the ink receiving section 75 are arranged at positions which are separate and away from each other in the main scanning direction.

Figure 4B:
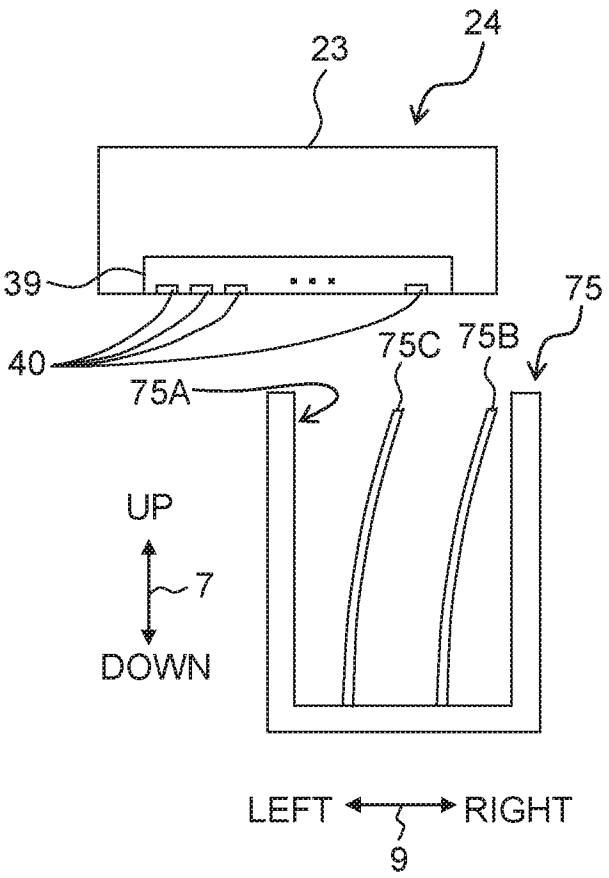
FIG. 4B is a view schematically depicting the configuration of an ink receiving section 75.
Figure 4A:
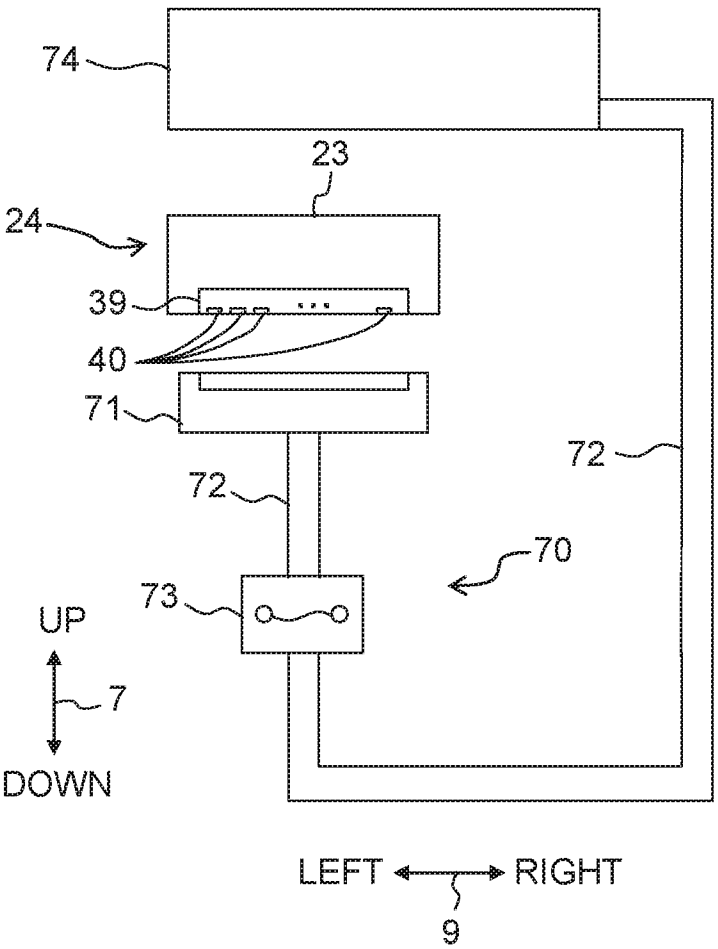
FIG. 4A is a view schematically depicting the configuration of a maintenance section 70.

As depicted in FIG. 4B, the ink receiving section 75 has a box-shape which is substantially rectangular parallelepiped and which has an opening 75A formed in the upper surface thereof. The width in the main scanning direction of the opening 75A is shorter than the width in the main scanning direction of the nozzle surface. Further, guide walls 75B and 75C each of which crosses the main scanning direction are arranged inside the ink receiving section 75, at positions apart in the left-right direction 9, respectively.

The guide walls 75B and 75C are each a plate-shaped member spreading in the up-down direction 7 and the front-rear direction 8. Further, the guide walls 75B and 75C are disposed such that each of the guide walls 75B and 75C is inclined in the left-right direction 9. More specifically, the guide walls 75B and 75C are arranged inside the ink receiving section 75 such that the left surface of each of the guide walls 75B and 75C faces (is oriented) in a left obliquely upward direction. Each of the guide walls 75B and 75C guides an ink droplet, which is jetted from the recording head 39, toward the interior or innermost surface (bottom surface) of the ink receiving section 75. Note that, however, the number of the guide walls 75B, 75C is not limited to 2 (two).

<Driving Force Transmitting Mechanism 80>

As depicted in FIG. 6, the printer 11 is further provided with a driving force transmitting mechanism 80. The driving force transmitting mechanism 80 is configured to transmit the driving forces generated by the feeding motor 101 and the conveyance motor 102 to the feeding rollers 25A, 25B, the conveyance roller 60, the discharge roller 62, the ascending/descending mechanism for the cap 71 and the pump 73. The driving force transmitting mechanism 80 is constructed by combining all or a part of: a gear, a pulley, an endless annular belt, a planetary gear mechanism (pendulum gear mechanism), a one-way clutch, and the like. Further, the driving force transmitting mechanism 80 is provided with a switching section 170 (see FIG. 5) configured to change a transmittance destination to which the driving forces generated by the feeding motor 101 and the conveyance motor 102 are transmitted.

<Switching Section 170>

Figure 5A:
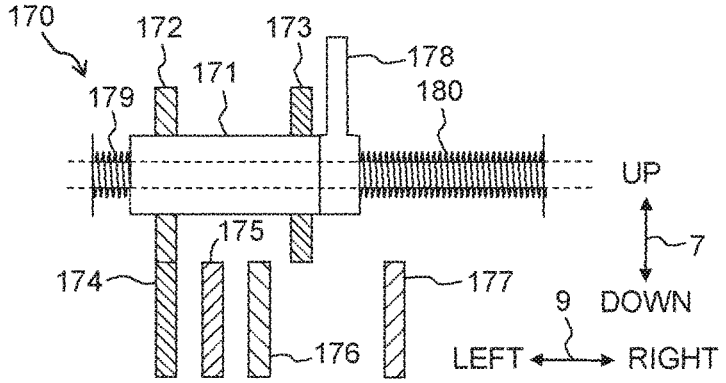
Figure 5B:
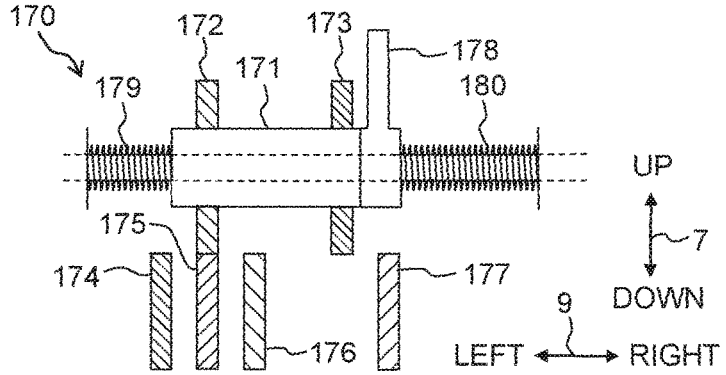
Figure 5C:
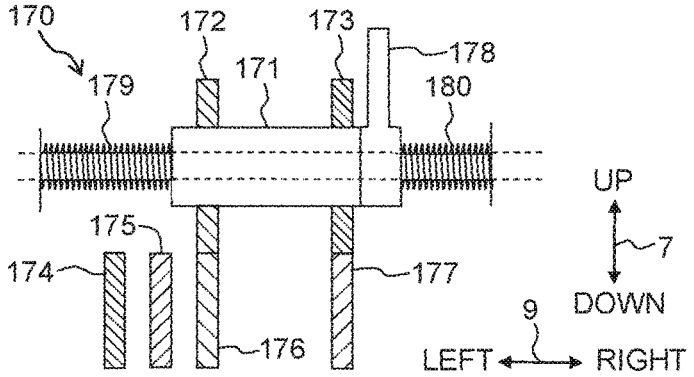

As depicted in FIG. 3, the switching section 170 is arranged on the right side from (relative to) the sheet facing area. Further, the switching section 170 is arranged at a location below the guide rail 43. As depicted in FIGS. 5A to 5C, the switching section 170 is provided with a sliding member 171, driving gears 172 and 173, gears 174, 175, 176 and 177, a lever 178 and springs 179 and 180. The switching section 170 is configured such that the state thereof is switchable to a first state, a second state and a third state.

The first state is such a state that the switching section 170 transmits the driving force of the feeding motor 101 to the feeding roller 25A, but the switching section 170 does not transmit the driving force of the feeding motor 101 to the feeding roller 25B and the ascending/descending mechanism for the cap 71. The second state is such a state that the switching section 170 transmits the driving force of the feeding motor 101 to the feeding roller 25B, but the switching section 170 does not transmit the driving force of the feeding motor 101 to the feeding roller 25A and the ascending/descending mechanism for the cap 71. The third state is such a state that the switching section 170 transmits the driving force of the feeding motor 101 to the ascending/descending mechanism for the cap 71, but the switching section 170 does not transmit the driving force of the feeding motor 101 to the feeding roller 25A and the feeding roller 25B. Further, each of the first state and the second state is also such a state that the switching section 170 transmits the driving force of the conveyance motor 102 to the conveyance roller 60 and the discharge roller 62, but the switching section 170 does not transmit the driving force of the conveyance motor 102 to the pump 73. The third state is also such a state that the switching section 170 transmits the driving force of the conveyance motor 102 to all of the conveyance roller 60, the discharge roller 62, and the pump 73.

The sliding member 171 is a substantially columnar-shaped member which is supported by a supporting shaft (indicated in broken lines in FIG. 5) extending in the left-right direction 9. Further, the sliding member 171 is configured to be slidable in the left-right direction 9 along the supporting shaft. Furthermore, the sliding member 171 supports the driving gears 172 and 173 such that the driving gears 172 and 173 are rotatable independently from each other at locations, on the outer circumferential surface of the sliding member 171, which are shifted or separated from each other in the left-right direction 9. Namely, the sliding member 171 and the driving gears 172 and 173 make a sliding movement in the left-right direction 9 integrally.

The driving gear 172 is rotated by the rotary driving force transmitted from the feeding motor 101 to the driving gear 172. The driving gear 172 meshes with one of the gears 174, 175 and 176. More specifically, in a case that the switching section 170 is in the first state, the driving gear 172 meshes with the gear 174, as depicted in FIG. 5A. Further, in a case that the switching section 170 is in the second state, the driving gear 172 meshes with the gear 175, as depicted in FIG. 5B. Furthermore, in a case that the switching section 170 is in the third state, the driving gear 172 meshes with the gear 176, as depicted in FIG. 5C.

The driving gear 173 is rotated by the rotary driving force transmitted from the conveyance motor 102 to the driving gear 173. In a case that the state of the switching section 170 is either one of the first state and the second state, the meshing of the driving gear 173 with the gear 177 is released, as depicted in FIGS. 5A and 5B. Further, in a case that the state of the switching section 170 is the third state, the driving gear 173 meshes with the gear 177, as depicted in FIG. 5C.

The gear 174 meshes with a gear train rotating the feeding roller 25A. Namely, the rotary driving force of the feeding motor 101 is transmitted to the feeding roller 25A by the meshing of the driving gear 172 with the gear 174. Further, the rotary driving force of the feeding motor 101 is not transmitted to the feeding roller 25A due to the release of meshing of the driving gear 172 with the gear 174.

The gear 175 meshes with a gear train rotating the feeding roller 25B. Namely, the rotary driving force of the feeding motor 101 is transmitted to the feeding roller 25B by the meshing of the driving gear 172 with the gear 175. Further, the rotary driving force of the feeding motor 101 is not transmitted to the feeding roller 25B due to the release of meshing of the driving gear 172 with the gear 175.

The gear 176 meshes with a gear train driving the ascending/descending mechanism for the cap 71. Namely, the rotary driving force of the feeding motor 101 is transmitted to the ascending/descending mechanism for the cap 71 by the meshing of the driving gear 172 with the gear 176. Further, the rotary driving force of the feeding motor 101 is not transmitted to the ascending/descending mechanism for the cap 71 due to the release of meshing of the driving gear 172 with the gear 176.

The gear 177 meshes with a gear train driving the pump 73. Namely, the rotary driving force of the conveyance motor 102 is transmitted to the pump 73 by the meshing of the driving gear 173 with the gear 177. Further, the rotary driving force of the conveyance motor 102 is not transmitted to the pump 73 due to the release of meshing of the driving gear 173 with the gear 177. On the other hand, the rotary driving force of the conveyance motor 102 is transmitted to the conveyance roller 60 and the discharge roller 62 not via the switching section 170. Namely, the conveyance roller 60 and the discharge roller 62 are rotated by the rotary driving force transmitted thereto from the conveyance motor 102, regardless of the state of the switching section 170.

The lever 178 is supported by the supporting shaft at a location adjacent to a right side portion of the sliding member 171. Further, the lever 178 is configured to be slidable in the left-right direction 9 along the supporting shaft. Furthermore, the lever 178 is projected upwardly. Moreover, a forward end (tip portion) of the lever 178 reaches up to a position at which the forward end is capable of contacting with the carriage 23, via an opening 43A (see FIG. 3) formed in the guide rail 43. The lever 178 is configured to be slidable in the left-right direction 9 by being contacted by the carriage 23 and by being separated from the carriage 23. Further, the switching section 170 is provided with a plurality of locking sections configured to lock the lever 178. Accordingly, the lever 178, in a state of being locked by a locking section among the plurality of locking sections and then being separated from the carriage 23 at a certain location, may remain at the certain location even after the lever 178 has been separated away from the carriage 23.

The springs 179 and 180 are supported by the supporting shaft. The spring 179 makes contact with the frame of the printer 11 at one end (left end) of the spring 179, and the spring 179 makes contact with the left end surface of the sliding member 171 at the other end (right end) of the spring 179. Namely, the spring 179 urges the sliding member 171 and the lever 178 contacting the sliding member 171 rightwardly. The spring 180 makes contact with the frame of the printer 11 at one end (right end) of the spring 180, and the spring 180 makes contact with the right end surface of the lever 178 at the other end (left end) of the spring 180. Namely, the spring 180 urges the lever 178 and the sliding member 171 contacting the lever 178 leftwardly. Further, the urging force of the spring 180 is greater than the urging force of the spring 179.

In a case that the lever 178 is locked by a first locking section included in the plurality of locking sections, the switching section 170 is in the first state. Then, the lever 178, pushed or pressed by the carriage 23 moving rightwardly, moves rightwardly against the urging force of the spring 180, and is locked by a second locking section located on the right side with respect to the first locking section. With this, the sliding member 171 moves rightwardly, by the urging force of the spring 179, following the movement of the lever 178. As a result, the state of the switching section 170 is changed from the first state depicted in FIG. 5A to the second state depicted in FIG. 5B. Namely, the lever 178 is contacted by the carriage 23 which is moving rightwardly toward the maintenance position to thereby switch the state of the switching section 170 from the first state into the second state.

Further, the lever 178, pressed by the carriage 23 moving rightwardly toward (or up to) the maintenance position, moves rightwardly against the urging force of the spring 180, and is locked by a third locking section located farther on the right side with respect to the second locking section. With this, the sliding member 171 moves rightwardly, by the urging force of the spring 179, following the movement of the lever 178. As a result, the state of the switching section 170 is changed from the first state depicted in FIG. 5A or the second state depicted in FIG. 5B to the third state depicted in FIG. 5C. Namely, the lever 178 is contacted by the carriage 23 which is moving rightwardly toward the maintenance position to thereby switch the state of the switching section 170 into the third state.

Furthermore, the lever 178, pressed by the carriage 23 moving farther rightwardly from the maintenance position and then separated away from the carriage 23 moving leftwardly, is released from the locking by the third locking section. With this, the sliding member 171 and the lever 178 are moved leftwardly by the urging force of the spring 180. Then, the lever 178 is locked by the first locking section. As a result, the state of the switching section 170 is changed from the third state depicted in FIG. 5C to the first state depicted in FIG. 5A. Namely, the lever 178 is separated from the carriage 23 which is moving leftwardly from the maintenance position to thereby switch the state of the switching section 170 from the third state into the first state.

Namely, the state of the switching section 170 is switched by the contact and separation of the carriage 23 with respect to the lever 178. In other words, the transmittance destinations of the driving forces of the feeding motor 101 and the conveyance motor 102 are switched by the carriage 23. Note that the state of the switching section 170 according to the present embodiment is not switched directly from the third state to the second state; rather, the state of the switching section 170 is required to be switched from the third state to the first state, then further switched from the first state to the second state, as described above.

<Power Supply 110>

The multi-function peripheral 10 has the power supply 110, as depicted in FIG. 6. The power supply 110 has a variety of kinds of electronic circuits configured to supply the electric power, supplied thereto from an external power supply via a power plug, to the respective constituent components, parts, etc., of the multi-function peripheral 10. More specifically, the power supply 110 outputs the electric power obtained from the external power supply as a driving voltage (for example, 24V) to the respective motors 101 to 103 and the recording head 39, and outputs the electric power as a controlling voltage (for example, 5V) to the controller 130.

Further, the power supply 110 is capable of being switched (switchable) between a driving state and a sleeping state, based on a power signal output from the controller 130. More specifically, the controller 130 outputs a HIGH level power signal (for example, 5V) to thereby switch the power supply 110 from the sleeping state to the driving state. On the other hand, the controller 130 outputs a LOW level power signal (for example, 0V) to thereby switch the power supply 110 from the driving state to the sleeping state.

The term "driving state" means a state in which the driving voltage is output to the motors 101 to 103 and to the recording head 39. In other words, the driving state means a state in which the motors 101 to 103 and the recording head 39 are each in an operable state or an active state. The term "sleeping state" means a state in which the driving voltage is not output to the motors 101 to 103 and to the recording head 39. In other words, the sleeping state means a state in which the motors 101 to 103 and the recording head 39 are each in an inoperative state or an inactive state. Although not depicted in the drawings, the power supply 110 outputs the controlling voltage to the controller 130 and a communicating section 50 (see FIG. 6), regardless of whether or not the power supply 110 is in the driving state or in the sleeping state.

<Controller 130>

As depicted in FIG. 6, the controller 130 is provided with a CPU 131, a ROM 132, a RAM 133, an EEPROM 134 and an ASIC 135 which are connected to one another by an internal bus 137. The ROM 132 stores various programs which are executed by the CPU 131 to thereby control a variety of kinds of operations. The RAM 133 is used as a storage area for temporarily storing a data and/or signal, etc., to be used when the CPU 131 executes the program(s), or as a working area for data processing. The EEPROM 134 stores setting information which should be retained even after the power supply of the multi-function peripheral 10 is switched off.

The feeding motor 101, the conveyance motor 102 and the carriage motor 103 are connected to the ASIC 135. The ASIC 135 generates a driving signal for rotating each of the motors, and outputs the generated driving signal to each of the motors. Each of the motors is driven to rotate in the normal direction or in the reverse direction, in accordance with the driving signal from the ASIC 135. Further, the controller 130 applies the driving voltage of the power supply 110 to the driving elements, via a non-illustrated driver IC of the recording head 39, to thereby cause the ink droplets to be jetted or discharged from the nozzles 40 corresponding to the driving elements, respectively.

Further, the communicating section 50 is connected to the ASIC 135. The communicating section 50 is a communicating interface capable of communicating with an information processing apparatus 51. Namely, the controller 130 transmits or sends a variety of kinds of information to the information processing apparatus 51 via the communicating section 50, and receives or accepts a variety of kinds of information from the information processing apparatus 51 via the communicating section 50. The communicating section 50 may be, for example, configured to transmit and receive a radio signal by a communication protocol in accordance with Wi-Fi (trade name by Wi-Fi Alliance), or may be an interface to which a LAN cable or a USB cable is connected. Note that in FIG. 6, the information processing apparatus 51 is surrounded by a frame drawn with a broken line so as to distinguish the information processing apparatus 51 from the constituents of the multi-function peripheral 10.

Further, the registration sensor 120, the rotary encoder 121, the carriage sensor 38, the media sensor 122 and the cap sensor 123 are connected to the ASIC 135. The controller 130 detects the position of the sheet 12 based on the detection signal output from the registration sensor 120 and the pulse signal output from the rotary encoder 121. Further, the controller 130 detects the position of the carriage 23 based on the pulse signal output from the carriage sensor 38. Furthermore, the controller 130 detects the position of the cap 71 based on the detection signal output from the cap sensor 123.

Moreover, the controller 130 detects the sheet 12 conveyed by the conveyance roller section 54 and the discharge roller section 55 based on the detection signal output from the media sensor 122. More specifically, the controller 130 compares an amount of change (change amount) in signal level between detection signals, which are temporarily adjacent, with a predetermined threshold value. Further, in response to that (under a condition that) the change amount in the signal level becomes to be not less than the threshold value, the controller 130 detects that a forward end or a tip end of the sheet 12 has reached a position at which the forward end faces the media sensor 122 in the up-down direction 7.

Further, the EEPROM 134 stores a voltage boosting table, as depicted in FIGS. 7A and 7B. The voltage boosting table is a table retaining (holding) information for boosting the driving voltage of the power supply 110 such that the driving voltage has a target voltage value (for example, 24V), in steps S13 and S21 (to be described later on). FIG. 7A depicts a first voltage boosting table indicating a first voltage boosting pattern, and FIG. 7B depicts a second voltage boosting table indicating a second voltage boosting pattern. The specific of the voltage boosting table will be described later on. The voltage boosting table is stored in the EEPPOM 134 in a process during which the multi-function peripheral 10 is manufactured. The boosting table may be stored in the ROM 132, instead of being stored in the EEPROM 134.

<Ink Discharging Processing>

Figure 8:
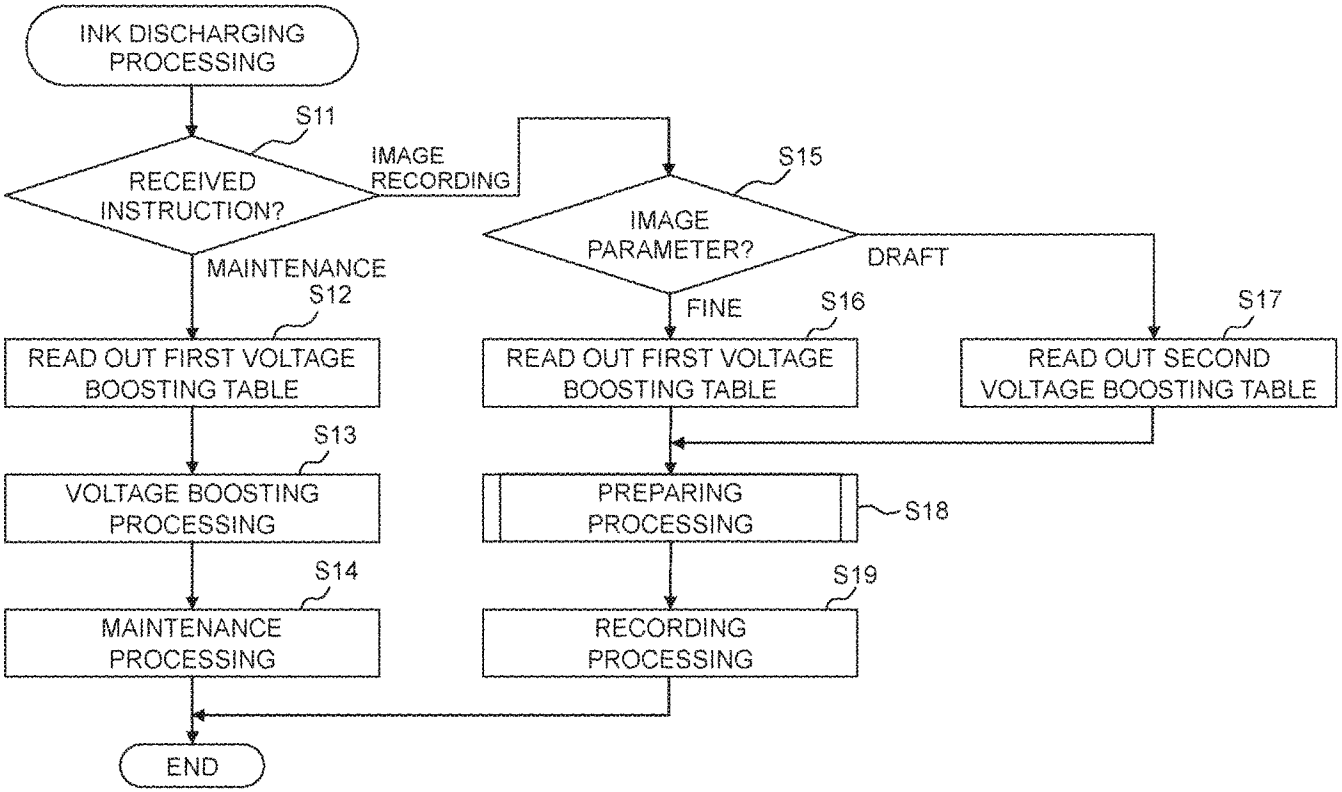
FIG. 8 is a flow chart of an ink discharging processing.

Next, an explanation will be given about an image recording processing of the embodiment, with reference to FIGS. 8 to 12. In a case that the multi-function peripheral 10 obtains or receives a discharging instruction for discharging an ink, the multi-function peripheral 10 executes an ink discharging processing as depicted in FIG. 8. The discharging instruction includes, for example, an image recording instruction for instructing execution of recording of an image on a sheet, and a maintenance instruction for instructing execution of a maintenance for the recording head 39 by the maintenance section 70. Although the method or manner by which the discharging instruction is obtained (received) is not particularly limited, it is allowable that the multi-function peripheral 10 obtains (receives) the image recording instruction from the information processing apparatus 51 via the communicating section 50, or that the multi-function peripheral 10 obtains the image recording instruction or the maintenance instruction from a user via a non-illustrated operation panel. Further, it is allowable to consider that the multi-function peripheral 10 obtains the maintenance instruction, in response to a situation that a timer set by the controller 130 times out.

Note that at a time of starting of the ink discharging processing, it is assumed that the carriage 23 is located at the maintenance position, the cap 71 is located at the covering position, and the switching section 170 is in the third state. The respective processing to be described below may be executed such that the CPU 131 reads out the program stored in the ROM 132 and executes the read program, or may be executed by a hardware circuit mounted on the controller 130. Note that the order of execution of the respective processings may be appropriately changed, without departing from the gist and/or scope of the present teaching.

At first, in a case that the controller 130 obtains the maintenance instruction (S11: Maintenance), the controller 130 reads out the first voltage boosting table depicted in FIG. 7A from the EEPROM 134 (S12). Then, the controller 130 boosts the driving voltage of the power supply 110 such that the driving voltage has the target voltage value (boosts the driving voltage of the power supply 110 to the target voltage value), in accordance with the first voltage boosting pattern indicated by the read first voltage boosting table (S13). The specific of the processing in step S13 will be described later on, with reference to FIGS. 10 to 12. The processing executed in step S13 in accordance with the first voltage boosting table which has been read in step S12 is an example of a first voltage boosting processing.

Next, under a condition that the driving voltage of the power supply 110 has reached the target voltage value, the controller 130 performs maintenance for the recording head 39 (S14). The processing executed in step S14 is an example of a maintenance processing. Further, the controller 130 stars a timer which times out at a timing at which the maintenance processing is to be started next time, and the controller 130 stands by until the controller 130 obtains the discharging instruction next time.

As an example, the controller 130 drives the conveyance motor 12 to thereby cause the pump 73 to suck the ink inside the nozzles 40 and applies the driving voltage which has been boosted to the target voltage value to all the driving elements. In such a manner, the controller 130 causes the pump 73 to suck the ink in the inside the nozzles 40 and then apples the driving voltage to all the driving elements, so as to discharge the ink from all the nozzles 40 toward the suction cap 71 at the covering position, thereby forming meniscus of the ink in the nozzles 40 as in a state provided before the ink has been sucked by the pump 73. This processing is an example of the maintenance processing, and is referred to a "purge processing", etc., in some cases.

As another example, the controller 130 applies the driving voltage boosted to the target voltage value to all the driving elements in a state that the recording head 39 is made to face (to be opposite to) the cap 71 or the ink receiving section 75. In such a manner, by applying the driving voltage to all of the driving elements, the controller 130 causes the ink to be discharged from all the nozzles 40 toward the suction cap 71 or the ink receiving section 75, thereby removing any dried ink in the nozzles 40 and forming meniscus of the ink in the nozzles 40. This processing is an example of the maintenance processing, and is referred to a "flushing processing", etc., in some cases.

On the other hand, in a case that the controller 130 obtains the image recording instruction (S11: Image Recording), the controller 130 determines the setting value of an execution parameter included in the obtained image recording instruction (S15). The execution parameter is information indicating an execution condition of a recording processing which will be described later on. In the execution parameter, for example, a value is set; the value is designated (specified) by the user inputting the image recording instruction via the information processing apparatus 51 or the non-illustrated operation panel. The execution parameter according to the present embodiment includes an image quality parameter indicating the resolution of an image to be recorded on the sheet 12. In the image quality parameter, a first value "Fine" or a second value "Draft" is set. The processing in step S15 is an example of a set value determining processing.

The first value "Fine" of the image quality parameter indicates a resolution higher than that indicated by the second value "Draft". In other words, a recording processing executed in accordance with the image quality parameter in which the first value "Fine" is set has an amount of the ink, to be landed on the sheet 12 per unit area of the sheet 12, which is larger as compared with a recording processing executed in accordance with the image quality parameter in which the second value "Draft" is set. Further in other words, the recording processing executed in accordance with the image quality parameter in which the first value "Fine" is set has an execution time of the recording processing which is longer as compared with the recording processing executed in accordance with the image quality parameter in which the second value "Draft" is set.

However, the specific example of the execution parameter is not limited to or restricted by the image quality parameter; the specific example of the execution parameter may include, for example:

the kind of the sheet 12 on which the image is to be recorded (in other words, the kind of the sheet 12 supported by the feed tray 20A or 20B; for example, the first value: "Glossy Paper sheet" and the second value: "Plain Paper sheet");

whether or not the ink is to be allowed to land on an outer edge of the sheet 12 (for example, the first value: "Without Margin", and the second value: "With Margin";

whether or not an image is to be recorded on both surfaces of the sheet 12 (for example, the first value: "Both Surfaces (Sides)", and the second value: "One Surface (Single Side)"; and the format of data indicating the image to be recorded on the sheet 12 (in other words, the format of the data included in the image recording instruction; for example, the first value: "Image Format (JPEG/TIFF), and the second value: "Document Format (txt/doc)"); and the like. Note that in all the specific examples of the execution parameter as indicated above, the second value is a value with which the execution time of the recording processing becomes shorter than the first value.

Next, under a condition that the controller 130 determines that the first value "Fine" is set in the execution parameter (S15: Fine), the controller 130 reads out the first voltage boosting table depicted in FIG. 7A from the EEPROM 134 (S16). On the other hand, under a condition that the controller 130 determines that the second value "Draft" is set in the execution parameter (S15: Draft), the controller 130 reads out the second voltage boosting table depicted in FIG. 7B from the EEPROM 134 (S17). Note that in such a case that the image recording processing includes a plurality of execution parameters, it is allowable that the controller 130 reads out the first voltage boosting table under a condition that the first value is set in at least one of the plurality of execution parameters. On the other hand, it is allowable, for example, that the controller 130 reads out the second voltage boosting table under a condition that the second value is set in all of the plurality of execution parameters.

Figure 9:
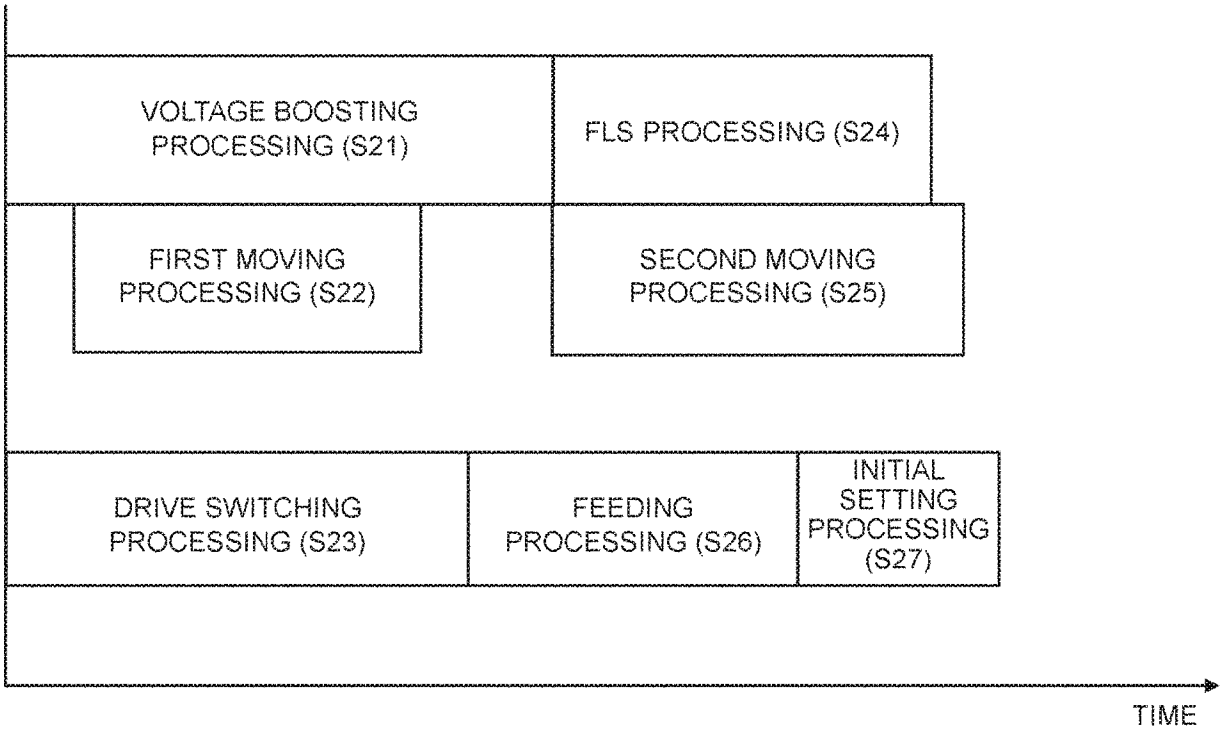
FIG. 9 is a timing chart depicting an execution timing for a preparing processing.

Next, the controller 130 executes a preparing processing (S18). The preparing processing is a processing for allowing the printer 11 to be in a state that the recording processing can be executed. The phrase that the "state that the recording processing can be executed" can be rephrased, for example, as a state that an image can be recorded with a quality of not less than a predetermined level. The preparing processing includes, for example, a voltage boosting processing (S21), a first moving processing (S22), and drive switching processing (S23), a FLS (flushing) processing (S24), a second moving processing (S25), a feeding processing (S26) and a positioning processing (initial setting processing, cue-feeding processing) (S27), as depicted in FIG. 9.

The voltage boosting processing (S21) is executed in accordance with the voltage boosting table which has been read out in step S16 or S17. The processing of step S21 is similar to that in step S13, and will be described later on, with reference to FIGS. 10 to 12. The processing of step S21 executed in accordance with the voltage boosting table which has been read in step S16 is an example of a first voltage boosting processing. The processing of step S21 executed in accordance with the voltage boosting table which has been read in step S17 is an example of a second voltage boosting processing.

The first moving processing (S22) is a processing for moving the carriage 23, which has been separated away from the cap 71, to a flushing position located on the left side with respect to the ink receiving section 75. Namely, the controller 130 causes the carriage 23 at the maintenance position to move rightwardly, and then to move leftwardly until the carriage 23 reaches the flushing position. Further, in order to suppress any destruction of the meniscus of the ink formed in the nozzles 40 of the recording head 39, it is allowable that the controller 130 causes the carriage 23 to move leftwardly at a low speed or velocity at the time at which step S22 is started, and then the controller 130 executes the processing of step S22.

The drive switching processing (S23) includes a processing for moving the cap 71 from the covering position to the separate position, and a processing for switching the state of the switching section 170 from the third state to the first state. Namely, the controller 130 rotates the feeding motor 101 just by a predetermined rotational amount. Then, by allowing the rotary driving force of the feeding motor 101 to be transmitted to the ascending/descending mechanism (for the cap 71) via the switching section 170 in the third state, the cap 71 is moved from the covering position to the separate position. Further, the controller 130 causes both of the feeding motor 101 and the conveyance motor 102 to rotate alternately in the normal and reverse directions. With this, since the bearing stress between the driving gear 172 and the gear 176 and the bearing stress between the driving gear 173 and the gear 177 are released, the meshings among the respective gears can be released smoothly. Further, the driving gear 172 and the gear 174 can be meshed with each other smoothly.

Note that as depicted in FIG. 9, the controller 130 executes the processings of steps S21 to S23 in parallel. More specifically, the controller 130 starts the processing of step S21 and the processing of step S23 at the same time at a timing at which the controller 130 receives the image recording instruction. Further, the controller 130 starts the processing of step S22 at a timing at which the detection signal from the cap sensor 123 is changed from the HIGH level signal to the LOW level signal. Namely, the controller 130 starts the processing of step S22 after starting the steps S21 and S23.

The FLS (flushing) processing (S24) is a processing for causing the ink droplets to be discharged from the respective nozzles 40 toward the ink receiving section 75, during a process of causing the carriage 23 to move rightwardly in the second moving processing. Namely, the controller 130 applies the driving voltage, which has been boosted to the target voltage value in the voltage boosting processing (S21), to each of the driving elements which corresponds to one of the nozzles 40, at discharge timings predetermined for the nozzles 40, respectively, thereby causing the ink to be discharged from all the nozzles 40.

An ink droplet jetting timing at which the ink droplets are jetted in the FLS processing is previously determined such that the ink droplets are allowed to land on the guide walls 75B and 75C. The jetting timing for each of the nozzles 40 is specified, for example, based the encoder value of the carriage sensor 38. In the present embodiment, at an initial timing, ink droplets are jetted from nozzle arrays on the right end and configured to jet the black ink and from nozzle arrays which are adjacent to the nozzle arrays, on the right end and configured to jet the black ink, and which are configured to jet the yellow ink; and then at a next timing, ink droplets are jetted from two groups of nozzle arrays located to be immediate left of the nozzle arrays from which the ink droplets of the black ink and the yellow inks have been jetted at the first timing. Namely, the controller 130 causes the ink droplets from each of the nozzles 40 in the nozzle arrangement order in the main scanning direction (namely, in an order from right to left).

The second moving processing (S25) is a processing for moving the carriage 23 rightwardly toward a detection position. Namely, the controller 130 drives the carriage motor 103 to thereby cause the carriage 23 rightwardly up to the detection position. The term "detection position" means a position which is located at the sheet facing area and at which the carriage 23 is capable of facing a sheet 12 of each of all the sizes (for example, A4, B4, L-size, etc.) supportable by the feed trays 20A and 20B. In a case that the sheet 12 is supported by the feed tray 20A or 20B in a state that the center in the main scanning direction of the sheet 12 is positioned with respect to the feed tray 20A or 20B, the detection position may be located at the center in the main scanning direction of the sheet facing area.

The feeding processing (S26) is a processing for causing the feeding section 15A to feed a sheet 12, supported by the feed tray 20A, up to a position at which the sheet 12 reaches the conveyance roller section 54. This feeding processing is executed in a case that the recording command indicates the feed tray 20A as the feeding source from where the sheet 12 is fed. The controller 130 causes the feeding motor 101 to rotate normally, and causes the feeding motor 101 to further rotate normally just by a predetermined rotation amount after the detection signal of the registration sensor 120 is changed from the LOW level signal to the HIGH level signal. Further, by the transmittance of the rotary driving force of the feeding motor 101 to the feeding roller 25A via the switching section 170 in the first state, the sheet 12 supported by the feed tray 20A is fed to the conveyance route 65.

The initial setting processing (cue-feeding processing) (S27) is a processing for causing the conveyance roller section 54 and the discharge roller section 55 to convey, in the conveyance direction 16, the sheet 12, which has been conveyed by the feeding processing and has reached the conveyance roller section 54, up to a facing position at which an area, of the sheet 12, in which an image is to be recorded first (hereinafter referred also to as a "recording area" or "initial recording area" in some cases) may face the recording head 39. The initial recording area on the sheet 12 is indicated in the image recording instruction. The controller 130 causes the conveyance motor 102 to rotate normally to thereby cause the conveyance roller section 54 and the discharge roller section 55 to convey the sheet 12, which has reached the conveyance roller section 54, until the initial recording area indicated by the image recording instruction faces the recording head 39. Further, the controller 130 uses the media sensor 122 to detect the forward end of the sheet 12 during the process in which the initial setting processing is being executed.

Note that the processings S24 to S27 cannot be started unless at least a portion of the processings S21 to S23 has been already completed. More specifically, the second moving processing cannot be started unless the voltage boosting processing and the first moving processing have been already completed, but can be started even if the drive switching processing has not been completed yet. Further, the FLS processing cannot be started unless the second moving processing has been started. Furthermore, the feeding processing cannot be started unless the drive switching processing has been already completed, but can be started even if the voltage boosting processing and the first moving processing have not been completed yet. Moreover, the initial setting processing cannot be started unless the feeding processing has been already completed.

Namely, in response to the completion of the voltage boosting processing and the first moving processing, the controller 130 starts the second moving processing. Then, after the controller 130 has started the second moving processing, the controller 130 starts the FLS processing. Namely, the controller 130 executes the second moving processing in parallel with the FLS processing. Furthermore, in response to the completion of the drive switching processing, the controller 130 starts the feeding processing. Then, in responses to the completion of the feeding processing, the controller 130 starts the initial setting processing.

Further, although not depicted in the drawings, in a case that the image recording instruction indicates the feed tray 20B as the feeding source from where the sheet 12 is fed and in response to the completion of the FLS processing, the controller 130 switches the state of the switching section 170 from the first state to the second state. Namely, the controller 130 causes the carriage 23 which is being moved in the second moving processing to further move rightwardly, and causes the lever 178 which has been locked by the first locking section to be locked by the second locking section. Further, in response to the switching of the switching section 170 into the second state, the controller 130 causes the carriage 23 to move leftwardly toward the detection position. Then, in response to the switching of the switching section 170 into the second state, the controller 130 starts the feeding processing for feeding the sheet 12 supported by the feed tray 20B.

Next, in response to the completion of all the processings included in the preparing processing, the controller 130 executes the recording processing in accordance with the received image recording instruction (S19). In other words, in response to the detection of the sheet 12 by the controller 130 via the media sensor 122 during the initial setting processing and in response to the completion of the initial setting processing by the controller 130, the controller 130 executes the recording processing. The recording processing includes, for example, a jetting processing and a conveying processing which are executed alternately, and a discharging processing. The jetting processing is a processing for causing the recording head 39 to jet ink droplets, in accordance with the image recording instruction, selectively with respect to the recording area of the sheet 12 which is made to face the recording head 39. The conveying processing is a processing for causing the conveyance roller section 54 and the discharge roller section 55 to convey the sheet 12 only (just) by an amount corresponding to a predetermined conveyance width along the conveyance direction 16. The discharging processing is a processing for causing the discharge roller section 55 to discharge the sheet 12, having an image recorded thereon, to the discharge tray 21.

Namely, the controller 130 moves the carriage 23 from one end to the other end of the sheet facing area, and applies the driving voltage boosted to the target voltage value selectively to the driving elements at a timing indicated by the image recording instruction. Next, under a condition that there is an image to be recorded on a next recording area, the controller 130 causes the conveyance roller section 54 and the discharge roller section 55 to convey the sheet 12 up to a position at which the next recording area faces the recording head 39. Until the controller 130 records image(s) on all the recording areas, the controller 130 executes the jetting processing and the conveying processing repeatedly. Next, under a condition that the image(s) have been recorded on all the recording areas, the controller 130 causes the discharge roller section 55 to discharge the sheet 12 to the discharge tray 21.

Although not depicted in the drawings, in a case that a predetermined time has elapsed since the completion of the recording processing (S19), the controller 130 moves the carriage 23 to the maintenance position, changes the state of the switching section 170 into the third state, and moves the cap 71 to the covering position. Further, in a case that a predetermined time has elapsed since the movement of the cap 71 to the covering position, the controller 130 switches the state of the power supply 110 from the driving state to the sleeping state.

<Voltage Boosting Processing>

Figure 10:
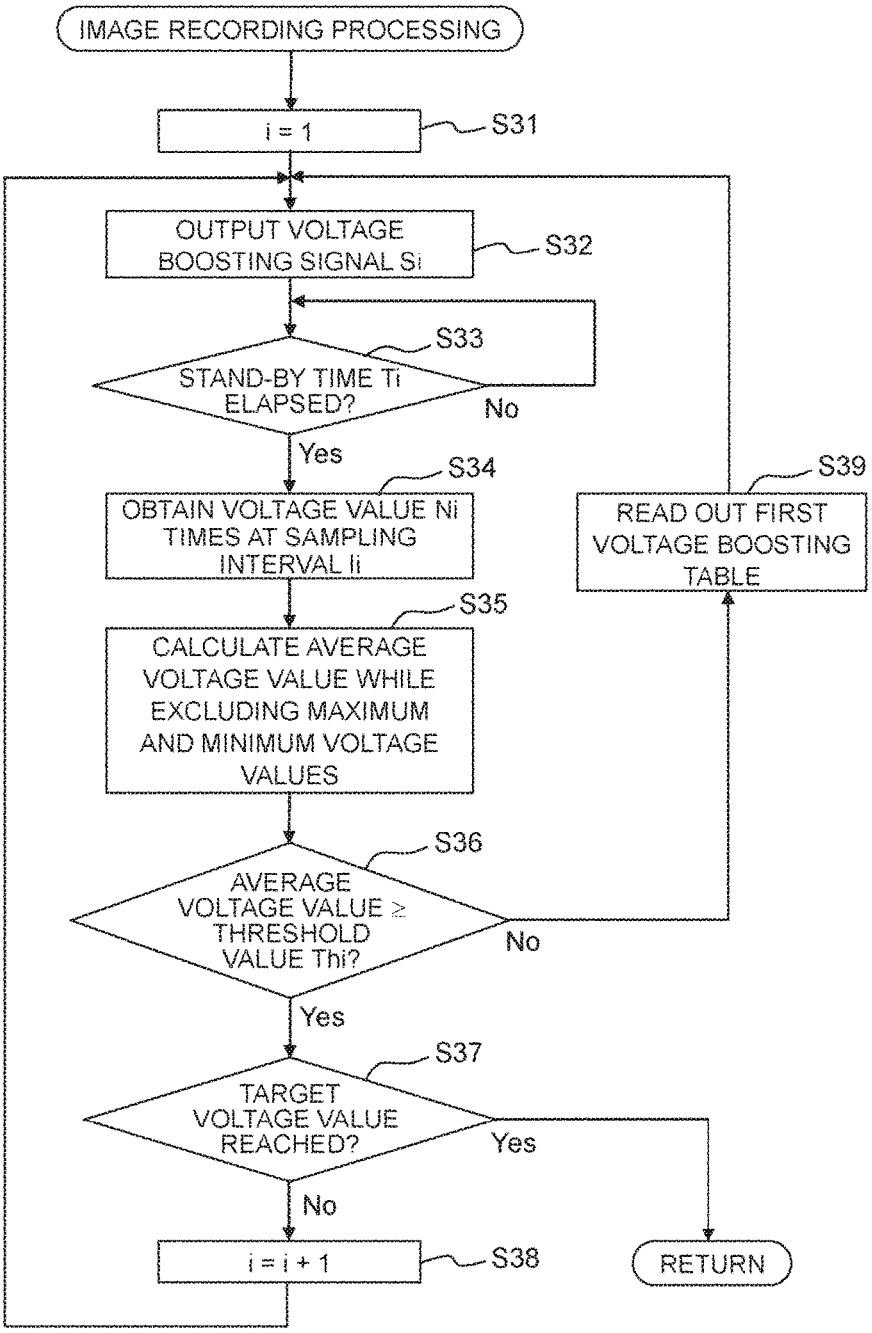
FIG. 10 is a flow chart of a voltage boosting processing.
Figure 11:
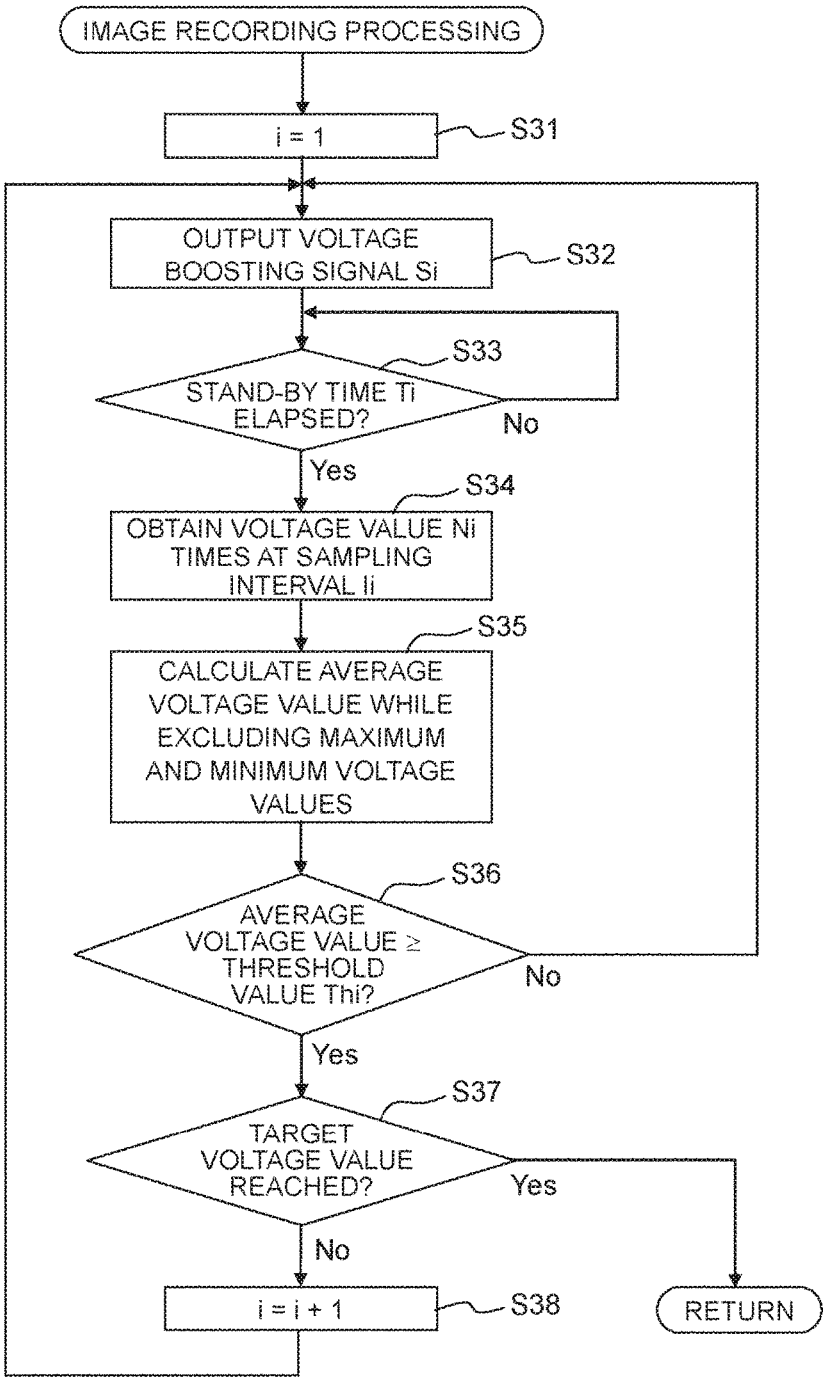
FIG. 11 is a flow chart of a voltage boosting processing.

Next, the voltage boosting processing of each of steps S13 and S21 will be explained in details with reference to FIGS. 10 to 12. The voltage boosting processing is a processing for boosting (raising) the driving voltage of the power supply 110 to have a target voltage value by repeating a plurality of voltage boosting steps. The plurality of voltage boosting steps as a whole is a processing for boosting the driving voltage of the power supply 110 to a set voltage value V. By the execution of the voltage boosting processing, the power supply 110 retains the driving voltage, which is to be applied to the driving elements so as to cause the ink to be jetted from the nozzles 40, in a non-illustrated condenser (capacitor), etc.

Each of records, included in the voltage boosting table, corresponds to one of the plurality of voltage boosting steps. The content of the processing in each of the voltage boosting steps is, for example, specified by the set voltage value V, a stand-by time T, a sampling interval I, a number of sampling count N, and a threshold value Th. The set voltage value V is a target value for the driving voltage which is to be boosted in each of the plurality of voltage boosting steps. The stand-by time T is a predetermined time which is considered as necessary for the driving voltage to reach the set voltage value V. The sampling interval I is an obtaining interval at which a present (current) value of the driving voltage is (to be) obtained. The number of sampling count N is a number of times for obtaining the present value of the driving voltage. The threshold value Th is a value which is (to be) compared with an average voltage value (to be described later on) so as to determine whether or not a certain voltage boosting step (among the plurality of voltage boosting steps) is completed normally. The set voltage value V is a value not more than the target voltage value, and the threshold value Th is a value less than a certain set voltage value V corresponding to the certain voltage boosting step.

In the following, among the plurality of voltage boosting steps, a voltage boosting step indicated by a record including a variable i=1 is referred to as a "first voltage boosting step", a voltage boosting step indicated by a record including a variable i=2 is referred to as a "second voltage boosting step", and a voltage boosting step indicated by a record including a variable i=3 is referred to as a "third voltage boosting step". Namely, the controller 130 executes the first voltage boosting step, the second voltage boosting step and the third voltage boosting step in this order in the voltage boosting processing.

In the following, an explanation will be made, with reference to FIG. 10, regarding an example of the voltage boosting processing in accordance with the second voltage boosting table depicted in FIG. 7B. Note that the driving voltage at the time of starting of the voltage boosting processing is 0 (zero) volt. Here, the set voltage value V (=22V) in the second voltage boosting step is higher than the set voltage value V (=14V) in the first voltage boosting step. Further, the set voltage value V (=24V) in the third voltage boosting step is higher than the set voltage value V (=22V) in the second voltage boosting step.

At first, the controller 130 substitute an initial value (=1) for the variable i (S31). Next, the controller 130 outputs a voltage boosting signal Si, instructing the boosting of the driving voltage to a set voltage value Vi (=14V) corresponding to the variable i, to the power supply 110 (S32). Namely, in the first voltage boosting step in FIG. 7B, the driving voltage of the power supply 110 is boosted from 0V to 14V. In the following, the difference between the driving voltage (=0V) at the time of starting of a certain voltage boosting step (in this case, the first voltage boosting step) and the set voltage value of the certain (first) voltage boosting step (=14V) is referred to as a "voltage boosting width". The processing in step S32 is an example of an instructing processing.

The voltage boosting signal Si is, for example, a pulse signal indicating a waveform of the driving voltage which is to be supplied to a non-illustrated regulator circuit in the power supply 110. The voltage boosting speed is controlled by a ratio of a HIGH level signal in the voltage boosting signal Si (hereinafter referred to as a "duty ratio"). Namely, in a case that the stand-by time T is same, as the voltage boosting width is greater, the voltage boosting signal Si is output with a greater duty ratio. Alternatively, in a case that the voltage boosting width is same, as the stand-by time T is shorter, the voltage boosting signal Si is output with a greater duty ratio. The power supply 110 boosts the driving voltage, supplied from the external power supply, to the set voltage value Vi by the regulator circuit. The phrase that "the power supply 110 is subjected to the voltage boosting", or that "the power supply 110 is boosted", or "to boost the driving voltage of the power supply 110" indicates, for example, in such a situation that an electric charge corresponding to the set voltage value Vi is accumulated in a power storage element such as the non-illustrated condenser, etc.

Figure 12:
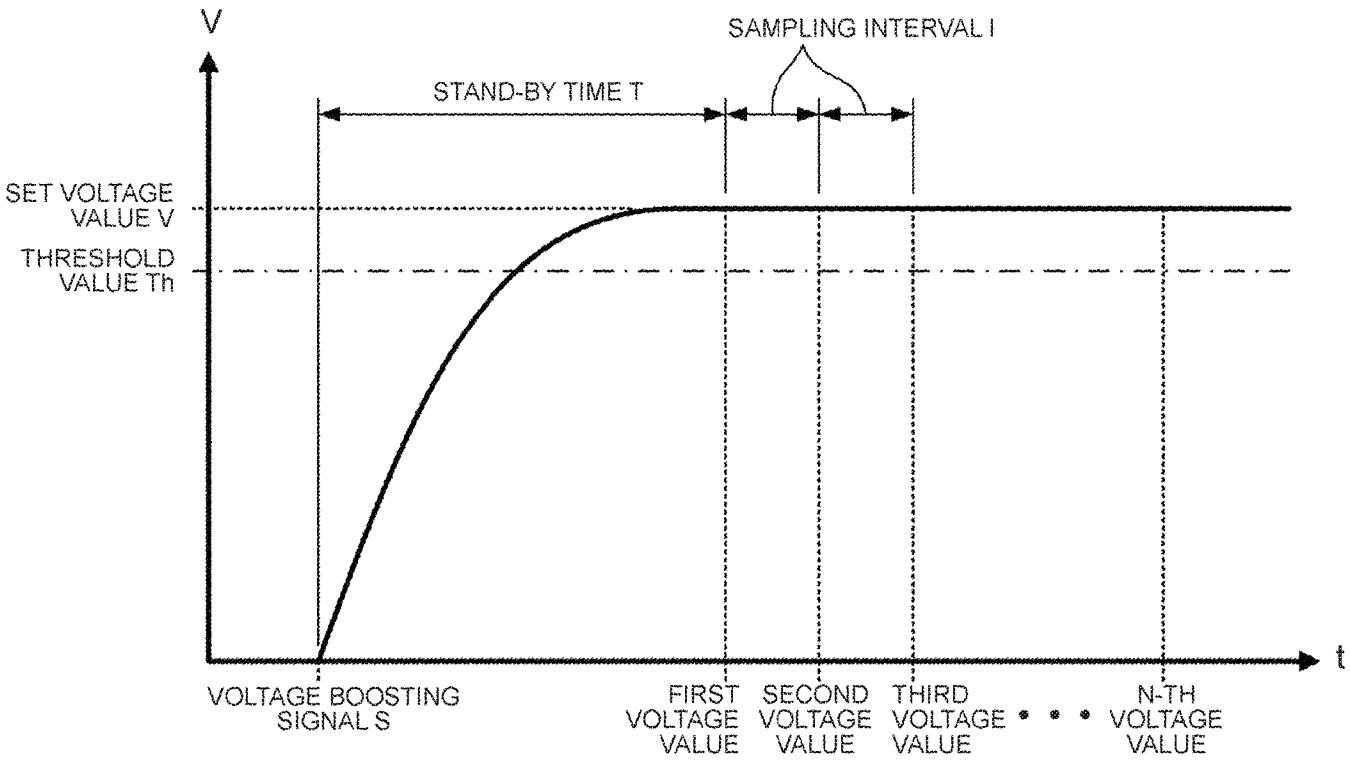
FIG. 12 is a view depicting the relationship among transition of driving voltage in voltage boosting steps, a set voltage value V, a stand-by time T, a sampling interval I, a number of sampling count N, and a threshold value Th.

With this, the driving voltage of the power supply 110 is boosted gradually, as depicted in FIG. 12. Further, the controller 130 stands by to execute the processing including and after the step S34, until a stand-by time Ti (=20 msec) corresponding to the variable i elapses (S33: NO) since the execution of the processing of step S32 (namely, the output of the boosting signal Si). Then, in a case that the stand-by time Ti has elapsed since the output of the boosting signal Si (S33: YES), the controller 130 obtains the present value of the driving voltage retained by the power supply 110 only (just) for a number of sampling count Ni (=three times) corresponding to the variable i, at a sampling interval Ii (=5 msec) corresponding to the variable i (S34). The processing of step S34 is an example of an obtaining processing.

More specifically, the controller 130 executes an A/D conversion to convert the present value of the driving voltage of the power supply 110 from an analogue value to a digital value, and causes the RAM 133 to temporarily store, as a first voltage value, the digitally converted present value. Next, in response to that the RAM 133 is caused to temporarily store the first voltage value, the controller 130 stands by until the sampling interval Ii elapses. Next, under a condition that the sampling interval Ii has elapsed, the controller obtains a second voltage value. A method for obtaining the second voltage value is similar to the method of obtaining the first voltage value. Further, the controller 130 repeats these processings, until the controller 130 obtains a Nth voltage value. With this, N pieces of the voltage value are obtained.

Next, the controller 130 excludes the maximum voltage value and the minimum voltage value from the N pieces of the voltage value that the controller 130 has caused the RAM to temporarily store therein. Then, the controller 130 calculates an average value of the remaining (N−2) pieces of the voltage value (hereinafter referred to as an "average voltage value") (S35). The average voltage value is an example of a representative value of the N pieces of the voltage value. However, the specific example of the representative value is not limited to or restricted by this; it is allowable, for example, that the representative value is an average value of the N pieces of the voltage value, or may be the median of the N pieces of the voltage value.

Next, the controller 130 determines whether or not the average voltage value calculated in step S35 is not less than a threshold value Thi (=13.0 V) corresponding to the variable i (S36). The processing in step S36 is an example of a voltage value determining processing. Next, under a condition that the controller 130 determines that the average voltage value is not less than the threshold value Thi (S36: YES), the controller 130 determines whether or not the driving voltage of the power supply 110 has reached the target voltage value (namely, whether or not the set voltage value Vi=the target voltage value) (S37).

Under a condition that the controller 130 determines that the driving voltage of the power supply 110 has not reached the target voltage value (S37: No), the controller 130 increments the variable i by 1 (one) (S38), and executes the processings of steps S32 to S37 again. Alternatively, under a condition that the controller 130 determines that the driving voltage of the power supply 110 has reached the target voltage value (S37: Yes), the controller 130 completes the voltage boosting processing. Namely, until the driving voltage of the power supply 100 has reached the target voltage value (S37: No), the controller 130 repeatedly executes the voltage boosting steps, while gradually increasing (raising) the set voltage value V and the threshold value Th.

Further, under a condition that the controller 130 determines, during the execution of the voltage boosting processing in accordance with the second voltage boosting table, that the average voltage value is less than the threshold value Thi (S36: No), the controller 130 reads out the first voltage boosting table depicted in FIG. 7A from the EEPROM 134 (S39). Then, the controller 130 executes the voltage boosting steps in accordance with the first voltage boosting table which has been read (S32 to S37). Namely, for example, under a condition that the controller 130 determines, during the second voltage boosting step (i=2) in accordance with the second voltage boosting table, that the average voltage value is less than a threshold value Th2 (S36: No), the controller 130 executes the second voltage boosting step in accordance with the first voltage boosting table, and the third voltage boosting step in accordance with the first voltage boosting table in this order.

Next, an example of the voltage boosting processing in accordance with the first voltage boosting table as depicted in FIG. 7A will be explained, with reference to FIG. 11. When compared with the above-described example of the voltage boosting processing in accordance with the second voltage boosting table as depicted in FIG. 7B, the example of the voltage boosting processing in accordance with the first voltage boosting table is similar to that of the example of the voltage boosting processing in accordance with the second voltage boosting table, except that a processing in a case that the average voltage value is determined in step S36 to be less than the threshold value Thi is different. Accordingly, any overlapping explanation with that of the example of the voltage boosting processing in accordance with the second voltage boosting table will be omitted. As depicted in FIG. 11, in a case that the controller 130 determines, during a certain voltage boosting step in accordance with the first voltage boosting table, that the average voltage value is less than the threshold value Thi (S36: No), the controller 130 executes again the processings of steps S32 to S36, without incrementing the variable i.

In the embodiment as described above, when comparing the first voltage boosting table and the second voltage boosting table depicted in FIGS. 7A and 7B, respectively, there is, for example, the following difference. As an example of the difference, the stand-by time T of the second voltage boosting table is shorter that of the first voltage boosting table. As another example, the sampling interval I of an i-th voltage boosting step in the second voltage boosting table is shorter than that in the first voltage boosting table. As yet another example, the number of sampling count N of the i-th voltage boosting step in the second voltage boosting table is smaller than that in the first voltage boosting table. As still another example, the threshold value Th of the i-th voltage boosting step in the second voltage boosting table is smaller than that in the first voltage boosting table. Although omitted in the drawings, the number of records in the second voltage boosting table (namely, the number of the voltage boosting step in the second voltage boosting pattern) may be made smaller than the number of records in the first voltage boosting table (namely, the number of the voltage boosting step in the first voltage boosting pattern).

By setting the voltage boosting tables as those depicted in FIGS. 7A and 7B, the execution time of the voltage boosting processing (hereinafter referred to as a "voltage boosting time") in accordance with the second voltage boosting pattern becomes shorter than that of the voltage boosting processing in accordance with the first voltage boosting pattern. Further, according to the above-described configuration, since the voltage boosting processing in accordance with the second voltage boosting pattern is executed in response to the receipt of the image recording instruction, it is possible to shorten the FPOT as compared with the case of executing the voltage boosting processing in accordance with the first voltage boosting pattern. Note that it is allowable that the first voltage boosting pattern and the second voltage boosting pattern are different from each other in view of at least one of the stand-by time T, the sampling interval I, the number of sampling count N, the threshold value Th and the number of times for which the voltage boosting step is repeated.

Note that the second voltage boosting pattern is not such a pattern by which the driving voltage is boosted rapidly to such an extent that any large load is applied to an electronic circuit configured to boost the voltage of the power supply 110. If, however, the voltage boosting processing in accordance with the second voltage boosting pattern is repeatedly executed, any small or slight load is consequently accumulated in the electronic circuit. In view of this, in a case that the maintenance processing for which the needs for shortening the execution time is lower than in the recording processing is executed, the first voltage boosting pattern in which the driving voltage is boosted in the relatively long voltage boosting time is used, thereby making it possible to reduce the load which would have otherwise accumulated in the electronic circuit.

Alternatively, in a case that the execution time of the recording processing is relatively short, the execution time of the voltage boosting processing has a great impact on the FPOT. Namely, it can be considered that, in a case that the second value is set in the execution parameter, the voltage boosting processing in accordance with the second voltage boosting pattern is suitable. On the other hand, in a case that the execution time of the recording processing is relatively long, the impact of the execution time of the voltage boosting processing on the FPOT is small, and thus it is more preferred to reduce the load on the electronic circuit, than to slightly shorten the execution time of the voltage boosting processing. Namely, it can be considered that, in a case that the first value is set in the execution parameter, the voltage boosting processing in accordance with the first voltage boosting pattern is suitable.

Further, in the voltage boosting steps in accordance with the second voltage boosting pattern, the execution time becomes shorter as compared with the voltage boosting steps in accordance with the first voltage boosting pattern, whereas there is such a possibility that the voltage might not be boosted to the set voltage value V. In view of this, in a case that the voltage boosting step(s) in accordance with the second voltage boosting pattern fails (is unsuccessful), it is preferred that the voltage boosting processing is continued in accordance with the first voltage boosting pattern, as in the above-described configuration.

Further, when comparing the respective records in the second voltage boosting table as depicted in FIG. 7B, there is, for example, the following different among the records. As an example, in a certain voltage boosting step of which set voltage value V is far from the target voltage value, the stand-by time T is shorter, the sampling interval I is shorter, and the number of sampling count N is smaller than those in another voltage boosting step of which set voltage value V is close to the target voltage value. Namely, the execution time of the first voltage boosting step is shorter than the execution time of the second voltage boosting step. Further, the execution time of the second voltage boosting step is shorter than the execution time of the third voltage boosting step. As another example, in the certain voltage boosting step of which set voltage value V is far from the target voltage value, the voltage boosting width is greater than that in the another voltage boosting step of which set voltage value V is close to the target voltage value. Namely, the voltage boosting width (14V) of the first voltage boosting step is greater than the voltage boosting width (8V) of the second voltage boosting step. Further, the voltage boosting width (8V) of the second voltage boosting step is greater than the voltage boosting width (2V) of the third voltage boosting step.

In a case that the value of the driving voltage exceeds the target voltage value, there is such a possibility that any load might be applied on an electronic circuit constructing the power supply 110 and that the ink might be erroneously jetted from the nozzle(s). In view of this, it is possible to shorten the voltage boosting time while reducing the load on the electronic circuit and suppressing the occurrence of erroneous jetting of the ink, by making the execution time of the first voltage boosting step, of which set voltage value V is far from the target voltage value, to be shorter than the execution times of the second and third voltage boosting steps each having the set voltage value V close to the target voltage value, as in the above-described configuration. Similarly, it is allowable that in the second and third voltage boosting steps each having the set voltage value V close to the target voltage value, the voltage boosting width is made smaller than the voltage boosting width in the first voltage boosting step, thereby preventing the driving voltage from exceeding the target voltage value in each of the third and second voltage boosting steps. On the other hand, in the first voltage boosting step in which the set voltage value V is far from the target voltage value, there is a low possibility that any load might be applied on the electronic circuit constructing the power supply and that the ink might be erroneously jetted from the nozzle(s). Thus, it is allowable that in the first voltage boosting step, the voltage boosting width is made great so as to shorten the voltage boosting time.

Although omitted in the drawings, it is allowable that the stand-by time T is made shorter as the voltage boosting width in a voltage boosting step included in the plurality of pieces of the voltage boosting step is smaller. Namely, in the example depicted in FIG. 7B, it is allowable that the stand-by time T in the third voltage boosting step is made shorter than that in the second voltage boosting step, and that the stand-by time T in the second voltage boosting step is made shorter than that in the first voltage boosting step. Generally, there is such a tendency that the time since the processing in step S32 has been executed and until the driving voltage is stabilized at the set voltage value V becomes longer as the voltage boosting width is greater, and becomes shorter as the voltage boosting width is smaller. In view of this, it is possible to shorten the execution time of the second voltage boosting processing while stabilizing the driving voltage, by making the stand-by time T be shorter, as the voltage boosting width in a voltage boosting step included in the plurality of pieces of the voltage boosting step is smaller.

By using the first voltage boosting pattern and the second voltage boosting pattern switchingly and appropriately as in the above-described embodiment, it is possible to realize both of the shortening of the FPOT and the reduction of the load on the electronic circuit. Namely, the maintenance instruction is an example of a voltage boosting instruction under a first condition, and the image recording instruction is an example of a voltage boosting instruction under a second condition. Note that, however, the using of the first and second voltage boosting patterns in a switching manner is not limited to or restricted by the above-described example.

As another example, in a case that the controller 130 receives a voltage boosting instruction which does not involve jetting of the ink, the controller 130 may execute the voltage boosting processing in accordance with the first voltage boosting pattern. On the other hand, in a case that the controller 130 receives a voltage boosting instruction which involves the jetting of the ink, the controller may execute the voltage boosting processing in accordance with the second voltage boosting pattern. Further, the controller 130 may apply the driving voltage, which has been boosted to have the target voltage value in accordance with the second voltage boosting pattern, to the driving elements to thereby jet the ink from the nozzles 40. This processing is an example of an applying processing.

The voltage boosting instruction which does not involve jetting of the ink is, for example, an instruction for executing the voltage boosting processing so as to check whether or not any breakage (disconnection) of wiring occurs between the power supply 110 and the driver IC of the recording head 39. The voltage boosting instruction which involves the jetting of the ink is, for example, the maintenance processing and the image recording processing as described above. The voltage boosting instruction which does not involve the jetting of the ink is another example of the voltage boosting instruction under the first condition, and the voltage boosting instruction which involves the jetting of the ink is another example of the voltage boosting instruction under the second condition. Namely, the first and second conditions may be any conditions provided that the first and second conditions are different from each other.

In the above-described embodiment, the explanation has been made regarding the example in which the steps S21 to S27 are executed in response to the receipt of the image recording instruction. However, the execution timing at which the processings of the steps S21 to S27 are executed is not limited to or restricted by the above-described example. For example, the image recording instruction transmitted from the information processing apparatus 51 may include a preceding command and a recording command. The preceding command is a command previously announcing transmittance of the recording command. The recording command is a command for instructing the execution of the recording processing.

At first, in response to receipt, from a user, an instruction for causing the multi-function peripheral 10 to execute the image recording processing, the information processing apparatus 51 transmits the preceding command to the multi-function peripheral 10. Next, in response to that the information processing apparatus 51 has transmitted the preceding command, the information processing apparatus 51 generates a raster data from an image data designated by the user. Then, the information processing apparatus 51 transmits a recording command which includes the generated raster data and an execution parameter to the multi-function peripheral 10.

On the other hand, the controller 130 of the multi-function peripheral 10 executes the processings of steps S21 to S23, in response to the receipt of the preceding command from the information processing apparatus 51 via the communicating section 50. Further, the controller 130 executes the processings of steps S24 to S27, in response to the receipt of the recording command from the information processing apparatus 51 via the communicating section 50 and in response to the completion of the processings of steps S21 to S23. According to the above-described configuration, it is possible to further shorten the FPOT. Furthermore, the voltage boosting processing in accordance with the second voltage boosting pattern achieves a particularly advantageous effect in a case that the time of receiving the recording command before the voltage boosting processing is completed is short (namely, the time required for generating the raster data is short).

Moreover, in the above-described embodiment, the explanation has been made regarding the example wherein the feeding rollers 25A and 25B, the ascending/descending mechanism for the cap 71, the conveyance roller 60, the discharge roller 62, and the pump 73 are driven by using the feeding motor 101 and the conveyance motor 102. It is allowable, however, that the feeding motor 101 is omitted and that the feeding rollers 25A and 25B, the ascending/descending mechanism for the cap 71, the conveyance roller 60, the discharge roller 62, and the pump 73 are driven by using the conveyance motor 102.

Further, in step S14 (the maintenance processing) of the above-described embodiment, the explanation has been made regarding the example wherein the controller 130 executes the flushing processing after executing the purge processing. However, the specific example of the maintenance processing is not limited to or restricted by this. As another example, it is allowable to execute only the flushing processing in step S14, which is executed in response to the time-out of the timer, so as to remove any dried ink in the inside of the nozzles 40.

Furthermore, in the above-described embodiment, the explanation has been made regarding the case wherein the recording head 39 is caused to jet the ink droplets in the process in which the carriage 23 is being moved in the main scanning direction. However, the recording head of the present teaching is not limited to or restricted by this; it is allowable, for example, that the recording head of the present teaching may be a so-called line head in which the nozzles are arranged over the entire area of the sheet facing area.

What is claimed is:

1. An ink-jet printer comprising:

a recording head having a plurality of nozzles and a plurality of driving elements corresponding to the plurality of nozzles, respectively;

a power supply configured to apply a driving voltage to the plurality of driving elements; and a controller, wherein in a case that the controller obtains an instruction of performing maintenance for the recording head, the controller is configured to perform:

boosting the driving voltage of the power supply to a target voltage value, in accordance with a first voltage boosting pattern; and applying the driving voltage, which has been boosted to the target voltage value, to at least one of the plurality of driving elements, and wherein in a case that the controller obtains an instruction of recording an image on a medium, the controller is configured to perform:

boosting the driving voltage of the power supply to the target voltage value, in accordance with a second voltage boosting pattern having a voltage boosting time being shorter than that in the first voltage boosting pattern; and recording the image on the medium by applying the driving voltage, which has been boosted to the target voltage value, selectively to the plurality of driving elements in accordance with the instruction of recording the image on the medium.

2. The ink-jet printer according to claim 1, wherein the controller is configured to repeatedly perform:

instructing the power supply to boost the driving voltage to a set voltage value V;

obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V, wherein under a condition that the controller determines that the representative value is not less than the threshold value Th, the controller is configured to repeatedly instruct the power supply to boost the driving voltage again to the set voltage value V, while raising the set voltage value V and the threshold value Th; and a number of the N times by which the N pieces of values of the driving voltage are obtained in the second voltage boosting pattern is smaller than a number of the N times by which the N pieces of values of the driving voltage are obtained in the first voltage boosting pattern.

3. The ink-jet printer according to claim 2, wherein in a case that the controller performs boosting the driving voltage of the power supply to the target voltage value in accordance with the second voltage boosting pattern, the controller is configured to change a voltage boosting width, which is a difference between a value of the driving voltage at a time of starting of the instructing and the set voltage value V, per each of the plurality of pieces of the voltage boosting, and the controller is configured to make the stand-by time T to be shorter as the voltage boosting width in a voltage boosting included in the plurality of pieces of the voltage boosting is smaller.

4. The ink-jet printer according to claim 2, wherein in a case that the controller performs boosting the driving voltage of the power supply to the target voltage value in accordance with the second voltage boosting pattern and under a condition that the controller determines that the representative value is less than the threshold value Th, the controller is configured to repeatedly instruct the power supply to boost the driving voltage again to the set voltage value V, by using the set voltage value V, the stand-by time T, the sampling interval I, the number of the N times and the threshold value T in the first voltage boosting pattern.

5. The ink-jet printer according to claim 1, wherein the controller is configured to repeatedly perform:

instructing the power supply to boost the driving voltage to a set voltage value V;

obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V, wherein under a condition that the controller determines that the representative value is not less than the threshold value Th, the controller is configured to repeatedly instruct the power supply to boost the driving voltage again to the set voltage value V, while raising the set voltage value V and the threshold value Th, and wherein the sampling interval I in the second voltage boosting pattern is shorter than the sampling interval I in the first voltage boosting pattern.

6. The ink-jet printer according to claim 1, wherein the controller is configured to repeatedly perform:

instructing the power supply to boost the driving voltage to a set voltage value V;

obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V, wherein under a condition that the controller determines that the representative value is not less than the threshold value Th, the controller is configured to repeatedly instruct the power supply to boost the driving voltage again to the set voltage value V, while raising the set voltage value V and the threshold value Th, and wherein the stand-by time T in the second voltage boosting pattern is shorter than the stand-by time T in the first voltage boosting pattern.

7. The ink-jet printer according to claim 1, wherein the controller is configured to repeatedly perform:

instructing the power supply to boost the driving voltage to a set voltage value V;

obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V, wherein under a condition that the controller determines that the representative value is not less than the threshold value Th, the controller is configured to repeatedly instruct the power supply to boost the driving voltage again to the set voltage value V, while raising the set voltage value V and the threshold value Th, and wherein the threshold value Th in the second voltage boosting pattern is smaller than the threshold value Th in the first voltage boosting pattern.

8. The ink-jet printer according to claim 1, wherein the controller is configured to repeatedly perform by a number of repetition count:

instructing the power supply to boost the driving voltage to a set voltage value V;

obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V;

wherein under a condition that the controller determines that the representative value is not less than the threshold value Th, the controller is configured to repeatedly instruct the power supply to boost the driving voltage again to the set voltage value V, while raising the set voltage value V and the threshold value Th, and wherein the number of the repetition count in the second voltage boosting pattern is smaller than the number of the repetition count in the first voltage boosting pattern.

9. The ink-jet printer according to claim 1, wherein the instruction of recording the image on the medium includes an execution parameter indicating an execution condition of the recording of the image, wherein in a case that the controller obtains the instruction of recording the image on the medium, the controller is configured to perform:

determining a set value of the execution parameter;

under a condition that the controller determines that the set value of the execution parameter is a first value, boosting the driving voltage of the power supply to the target voltage value in accordance with the first voltage boosting pattern; and under a condition that the controller determines that the set value of the execution parameter is a second value by which an execution time of the recording of the image becomes shorter than by the first value, boosting the driving voltage of the power supply to the target voltage value in accordance with the second voltage boosting pattern, and wherein the controller is configured to perform recording of the image on the medium in accordance with the execution condition indicated by the execution parameter.

10. The ink-jet printer according to claim 9, wherein in a case that the execution parameter indicates a resolution of an image to be recorded on the medium, the second value indicates a resolution lower than a resolution indicated by the first value.

11. The ink-jet printer according to claim 9, wherein in a case that the execution parameter indicates a kind of the medium, the first value indicates a glossy paper sheet included in the medium and the second value indicates a plain paper sheet included in the medium.

12. The ink-jet printer according to claim 9, wherein in a case that the execution parameter indicates whether or not an ink is to be allowed to land on an outer edge of the medium, the first value indicates that the ink is to be allowed to land on the outer edge, and the second value indicates that the ink is not to be allowed to land on the outer edge.

13. The ink-jet printer according to claim 9, wherein in a case that the execution parameter indicates whether or not the image is to be recorded on both surfaces of the medium, the first value indicates that the image is to be recorded on the both surfaces of the medium, and the second value indicates that the image is to be recorded only on one of the both surfaces of the medium.

14. The ink-jet printer according to claim 9, wherein in a case that the execution parameter indicates a format of data indicating the image to be recorded on the medium, the first value indicates an image format, and the second value indicates a document format.

15. The ink-jet printer according to claim 1, further comprising a maintenance section configured to discharge an ink in the plurality of nozzles as the maintenance, and wherein the controller is configured to control the maintenance section to discharge the ink in the plurality of nozzles before applying the driving voltage, boosted to the target voltage value, to at least one of the plurality of driving elements.

16. An ink-jet printer comprising:

a recording head having a plurality of nozzles and a plurality of driving elements corresponding to the plurality of nozzles, respectively;

a power supply configured to apply a driving voltage to the plurality of driving elements; and a controller, wherein in a case that the controller obtains an instruction of boosting of the driving voltage, the controller is configured to repeatedly perform, in an execution time Tx:

instructing the power supply to boost the driving voltage to a set voltage value V;

obtaining a value of the driving voltage, output by the power supply, N times at a sampling interval I to obtain N pieces of values of the driving voltage, in a case that a stand-by time T has elapsed since execution of the instructing; and determining whether or not a representative value of the obtained N pieces of values is not less than a threshold value Th being lower than the set voltage value V, wherein under a condition that the controller determines that the representative value is not less than the threshold value Th, the controller is configured to instruct the power supply to boost the driving voltage again to the set voltage value V, while raising the set voltage value V and the threshold value Th, and wherein the controller is configured to make the execution time Tx, in a case that the set voltage value V is a first voltage value, to be shorter than the execution time Tx in a case that the set voltage value V is a second voltage value higher than the first voltage value.

17. The ink-jet printer according to claim 16, wherein the controller is configured to make a number of the N times, by which the N pieces of values of the driving voltage are obtained, in the case that the set voltage value V is the first voltage value, to be smaller than the number of the N times in the case that the set voltage value V is the second voltage value.

18. The ink-jet printer according to claim 16, wherein the controller is configured to make the sampling interval I, in the case that the set voltage value V is the first voltage value, to be shorter than the sampling interval I in the case that the set voltage value V is the second voltage value.

19. The ink-jet printer according to claim 16, wherein the controller is configured to make the stand-by time T, in the case that the set voltage value V is the first voltage value, to be shorter than the stand-by time T in the case that the set voltage value V is the second voltage value.

20. The ink-jet printer according to claim 16, wherein the controller is configured to make a voltage boosting width, which is a difference between a value of the driving voltage at a time of starting of the instructing and the set voltage value V, in the case that the set voltage value V is the first voltage value, to be greater than the voltage boosting width in the case that the set voltage value V is the second voltage value.

21. An ink-jet printer comprising:

a recording head having a plurality of nozzles and a plurality of driving elements corresponding to the plurality of nozzles;

a power supply configured to apply a driving voltage to the plurality of driving elements; and a controller, wherein in a case that the controller obtains a voltage boosting instruction which does not involve jetting of an ink from the plurality of nozzles, the controller is configured to perform boosting the driving voltage of the power supply to a target voltage value, in accordance with a first voltage boosting pattern, wherein in a case that the controller obtains a voltage boosting instruction which involves the jetting of the ink, the controller is configured to perform boosting of the driving voltage of the power supply to the target voltage value, in accordance with a second voltage boosting pattern having a voltage boosting time being shorter than that in the first voltage boosting pattern, and wherein the controller is configured to apply the driving voltage, which has been boosted to the target voltage value, to the plurality of driving elements.

22. An ink-jet printer comprising:

a recording head having a plurality of nozzles and a plurality of driving elements corresponding to the plurality of nozzles, respectively;

a power supply configured to apply a driving voltage to the plurality of driving elements; and a controller, wherein in a case that the controller obtains a voltage boosting instruction under a first condition, the controller is configured to perform boosting the driving voltage of the power supply to a target voltage value, in accordance with a first voltage boosting pattern, and wherein in a case that the controller obtains a voltage boosting instruction under a second condition being different from the first condition, the controller is configured to perform boosting the driving voltage of the power supply to the target voltage value, in accordance with a second voltage boosting pattern in which a voltage boosting time is shorter than that in the first voltage boosting pattern.

* * * * *